US012669245B2

(12) United States Patent
Ganiger et al.

(10) Patent No.: US 12,669,245 B2
(45) Date of Patent: Jun. 30, 2026

(54) COMBUSTOR FOR A TURBINE ENGINE INCLUDING AN INSULATING MEMBER

(71) Applicant: General Electric Company, Schenectady, NY (US)

(72) Inventors: Ravindra Shankar Ganiger, Bengaluru (IN); Hiranya Nath, Bengaluru (IN); Michael A. Benjamin, Cincinnati, OH (US)

(73) Assignee: GENERAL ELECTRIC COMPANY, Evendale, OH (US)

( * ) Notice: Subject to any disclaimer, the term of this patent is extended or adjusted under 35 U.S.C. 154(b) by 0 days.

(21) Appl. No.: 18/736,958

(22) Filed: Jun. 7, 2024

(65) Prior Publication Data

US 2025/0377108 A1 Dec. 11, 2025

(51) Int. Cl.

| | |
|---|---|
| ***F23R 3/28*** | (2006.01) |
| ***F02C 7/20*** | (2006.01) |
| ***F02C 7/24*** | (2006.01) |
| ***F02K 1/82*** | (2006.01) |
| ***F23M 5/04*** | (2006.01) |
| ***F23R 3/00*** | (2006.01) |
| ***F23R 3/60*** | (2006.01) |

(52) U.S. Cl.

CPC ..... *F23R 3/286* (2013.01); *F02C 7/20* (2013.01); *F02C 7/24* (2013.01); *F02K 1/822* (2013.01); *F23M 5/04* (2013.01); *F23R 3/002* (2013.01); *F23R 3/60* (2013.01); *F23R 2900/00017* (2013.01)

(58) Field of Classification Search

CPC .. F23R 3/002; F23R 3/283; F23R 3/60; F23R 2900/00012; F23R 2900/00017; F02C 7/20; F02C 7/24; F01K 1/82; F01K 1/822; F23M 5/04

See application file for complete search history.

(56) References Cited

U.S. PATENT DOCUMENTS 4,292,810 A * 10/1981 Glenn ..... F23R 3/08 60/757
5,363,643 A 11/1994 Halila
8,191,224 B2 6/2012 Richards
8,943,835 B2 2/2015 Corsmeier et al.

(Continued)

OTHER PUBLICATIONS

Gill et al., "Stress relaxation of nickel-based superalloy helical springs at high temperatures," Materials Science and Engineering: A, vol. 613, pp. 117-129, 2014.

(Continued)

*Primary Examiner* — Kyle Robert Thomas
(74) *Attorney, Agent, or Firm* — Venable LLP; Andrew W. Bradshaw; Michele V. Frank

(57) ABSTRACT

A combustor for a turbine engine includes a combustion chamber for combustion of fuel and air and the combustion of the fuel and air generates heat. A mixer assembly is disposed at a forward end of the combustor for receiving and mixing the fuel and the air and injecting the fuel and the air into the combustion chamber for the combustion. An insulating member is attached to at least one structural member and the insulating member defines the combustion chamber, at least in part. The insulating member has a functional thickness and is fastened to the at least one structural member without reduction in the functional thickness of the insulating member.

20 Claims, 16 Drawing Sheets

(56) References Cited

U.S. PATENT DOCUMENTS

| | | | | |
|---|---|---|---|---|
| 9,933,161 | B1 | 4/2018 | Papple | |
| 9,945,257 | B2 | 4/2018 | Fitzpatrick et al. | |
| 10,451,277 | B2 * | 10/2019 | Chandler | F23R 3/16 |
| 10,563,865 | B2 * | 2/2020 | Chang | B32B 18/00 |
| 10,816,210 | B2 * | 10/2020 | Lind | F23R 3/343 |
| 10,969,103 | B2 | 4/2021 | Chang et al. | |
| 11,346,555 | B2 | 5/2022 | Freeman et al. | |
| 11,441,777 | B2 | 9/2022 | Corsmeier | |
| 11,466,719 | B2 | 10/2022 | Bodecker et al. | |
| 11,536,454 | B2 * | 12/2022 | Hu | F23R 3/002 |
| 11,781,753 | B2 | 10/2023 | Ganiger et al. | |
| 2016/0186997 | A1 | 6/2016 | Sadil et al. | |
| 2023/0296251 | A1 | 9/2023 | Sampath et al. | |
| 2024/0133556 | A1 | 4/2024 | Ganiger et al. | |

OTHER PUBLICATIONS

Yang et al., "Cyclic loading behavior of micro-sized polycrystalline copper wires," Procedia Engineering, vol. 2, Issue 1, pp. 925-930, 2010.

* cited by examiner

COMBUSTOR FOR A TURBINE ENGINE INCLUDING AN INSULATING MEMBER

TECHNICAL FIELD

The present disclosure relates generally to a turbine engine with a combustor and an insulating member, such as a heat shield.

BACKGROUND

Turbine engines, for example, for aircraft, generally include a fan and a turbo-engine arranged in flow communication with one another. A combustor receives fuel and air, generates a fuel and air mixture, and combusts the fuel and air mixture. The combustion of the fuel and air generates heat. A heat shield protects components of the combustor from the heat generated by the combustion.

BRIEF DESCRIPTION OF THE DRAWINGS

Features and advantages will be apparent from the following, more particular, description of various exemplary embodiments, as illustrated in the accompanying drawings, wherein like reference numbers generally indicate identical, functionally similar, and/or structurally similar elements.

DETAILED DESCRIPTION

Figure 1:
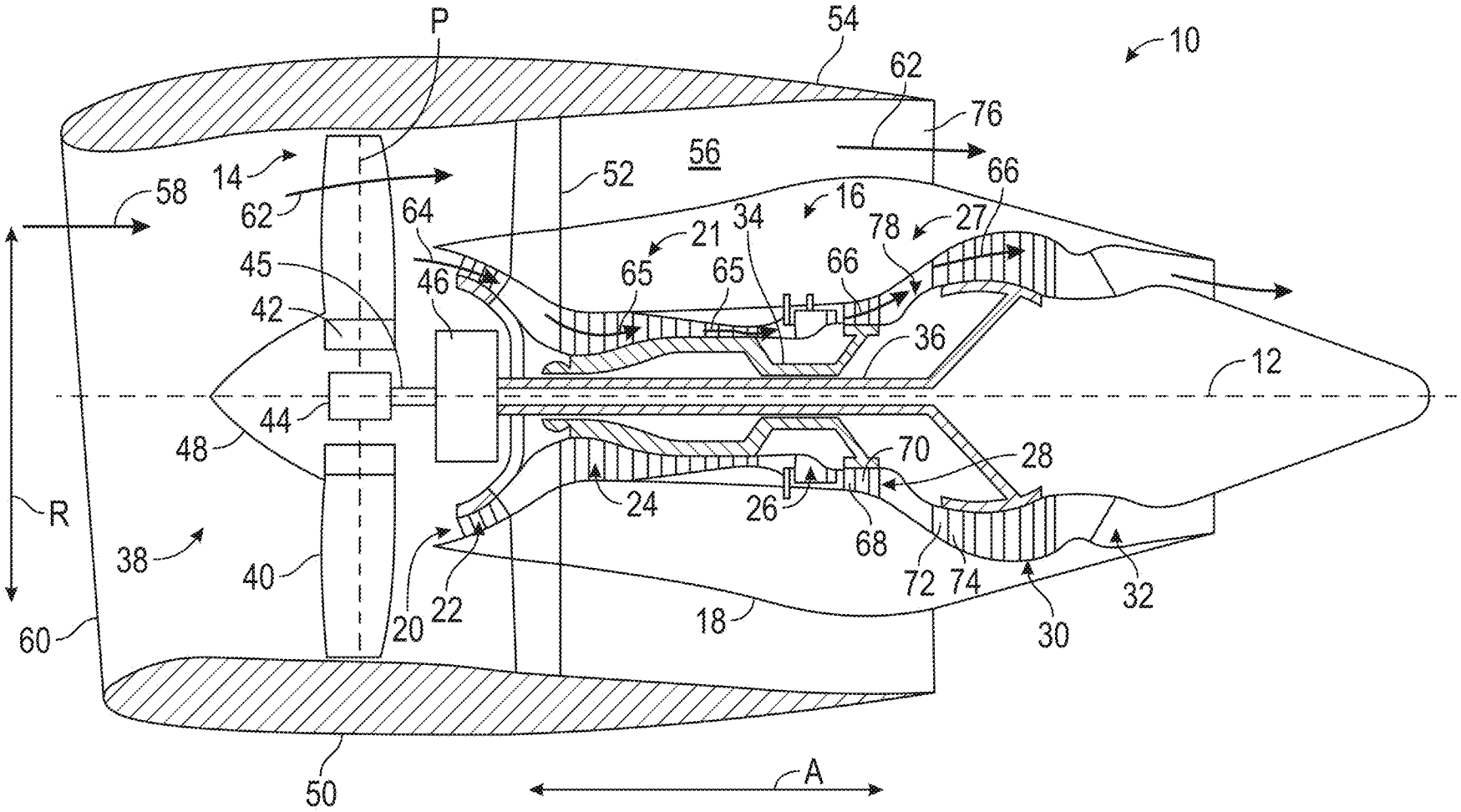
FIG. 1 is a schematic cross-sectional view of a turbine engine, taken along a longitudinal centerline axis of the turbine engine, according to the present disclosure.

Features, advantages, and embodiments of the present disclosure are set forth or apparent from a consideration of the following detailed description, drawings, and claims. Moreover, the following detailed description is exemplary and intended to provide further explanation without limiting the disclosure as claimed.

Various embodiments of the present disclosure are discussed in detail below. While specific embodiments are discussed, this is done for illustration purposes only. A person skilled in the relevant art will recognize that other components and configurations may be used without departing from the present disclosure.

As used herein, the terms "first" and "second" may be used interchangeably to distinguish one component from another and are not intended to signify location or importance of the individual components.

The terms "upstream" and "downstream" refer to the relative direction with respect to fluid flow in a fluid pathway. For example, "upstream" refers to the direction from which the fluid flows, and "downstream" refers to the direction to which the fluid flows.

The terms "forward" and "aft" refer to relative positions within a turbine engine or vehicle, and refer to the normal operational attitude of the turbine engine or vehicle. For example, with regard to a turbine engine, forward refers to a position on the turbine engine that is closer to the propeller or the fan and aft refers to a position on the turbine engine that is further away from the propeller or the fan.

As used herein, the terms "low" and "high," or their respective comparative degrees (e.g., "lower" and "higher", where applicable), when used with compressor, combustor, turbine, shaft, fan, or turbine engine components, each refers to relative pressures, relative speeds, relative temperatures, or relative power outputs within an engine unless otherwise specified. For example, a "low-power" setting defines the engine or the combustor configured to operate at a power output lower than a "high-power" setting of the engine or the combustor. The terms "low" or "high" in such aforementioned terms may additionally, or alternatively, be understood as relative to minimum allowable speeds, pressures, or temperatures, or minimum or maximum allowable speeds, pressures, or temperatures relative to normal, desired, steady state, etc., operation of the engine.

The terms "coupled," "fixed," "fastened," "connected," and the like, refer to both direct coupling, fixing, fastening, or connecting, as well as indirect coupling, fixing, fastening, or connecting through one or more intermediate components or features, unless otherwise specified herein.

The singular forms "a," "an," and "the" include plural references unless the context clearly dictates otherwise.

As used herein, a "turbo-engine" includes a compressor section, a combustor, and a turbine section.

As used herein, a "turbofan engine" includes a turbo-engine and a fan that directs air into the turbo-engine, and rated for use in a regional aircraft, narrow body aircraft, or wide body aircraft. A turbofan engine rated for use on a regional aircraft will have a maximum takeoff thrust in a range of ten thousand pound-force to twenty thousand pound-force (10,000 lbf to 20,000 lbf). A turbofan engine rated for use on a narrow body aircraft will have a maximum takeoff thrust in a range of fifteen thousand pound-force to thirty thousand pound-force (15,000 lbf to 30,000 lbf). A turbofan engine rated for use on a wide body aircraft will have a maximum takeoff thrust in a range of forty thousand pound-force to one hundred ten thousand pound-force (40,000 lbf to 110,000 lbf).

As used herein, the term "ducted engine" means a turbofan engine with a fan casing or a nacelle that circumferentially surrounds the fan.

As used herein, an "unducted fan engine" or an "open fan engine" means a turbofan engine without a fan casing or a nacelle surrounding the fan.

Hereafter, the term "turbofan engine" will refer to either a "ducted engine" or an "open fan engine."

Approximating language, as used herein throughout the specification and claims, is applied to modify any quantitative or geometric representation that could permissibly vary without resulting in a change in the basic function to which it is related. Accordingly, a value or a geometry modified by a term or terms, such as "generally," and "substantially" is not to be limited to the precise value or the exact geometry specified.

The term "composite," as used herein, is indicative of a material having two or more constituent materials. A composite can be a combination of at least two or more metallic, non-metallic, or a combination of metallic and non-metallic elements or materials. Examples of a composite material can be, but not limited to, a polymer matrix composite (PMC), a ceramic matrix composite (CMC), a metal matrix composite (MMC). The composite may be formed of a matrix material and a reinforcing element, such as a fiber (referred to herein as a reinforcing fiber).

As used herein, CMC (or Ceramic Matrix Composite) refers to a class of materials with reinforcing fibers in a ceramic matrix. Generally, the reinforcing fibers provide structural integrity to the ceramic matrix. Some examples of reinforcing fibers can include, but are not limited to, non-oxide silicon-based materials (e.g., silicon carbide, silicon nitride, or mixtures thereof), non-oxide carbon-based materials (e.g., carbon), oxide ceramics (e.g., silicon oxycarbides, silicon oxynitrides, aluminum oxide ($Al_2O_3$), silicon dioxide ($SiO_2$), aluminosilicates such as mullite, or mixtures thereof), or mixtures thereof.

Some examples of ceramic matrix materials can include, but are not limited to, non-oxide silicon-based materials (e.g., silicon carbide, silicon nitride, or mixtures thereof), oxide ceramics (e.g., silicon oxycarbides, silicon oxynitrides, aluminum oxide ($Al_2O_3$), silicon dioxide ($SiO_2$), aluminosilicates, or mixtures thereof), or mixtures thereof. Optionally, ceramic particles (e.g., oxides of Si, Al, Zr, Y, and combinations thereof) and inorganic fillers (e.g., pyrophyllite, wollastonite, mica, talc, kyanite, and montmorillonite) can also be included within the ceramic matrix.

Generally, particular CMCs can be referred to by their combination or type of fiber/type of matrix. For example, C/SiC for carbon-fiber-reinforced silicon carbide, SiC/SiC for silicon carbide-fiber-reinforced silicon carbide, SiC/SiN for silicon carbide fiber-reinforced silicon nitride, SiC/SiC—SiN for silicon carbide fiber-reinforced silicon carbide/silicon nitride matrix mixture, etc. In other examples, the CMCs can be comprised of a matrix and reinforcing fibers comprising oxide-based materials such as aluminum oxide ($Al_2O_3$), silicon dioxide ($SiO_2$), aluminosilicates, and mixtures thereof. Aluminosilicates can include crystalline materials such as mullite ($3Al_2O_3 \cdot 2SiO_2$), as well as glassy aluminosilicates.

In certain non-limiting examples, the reinforcing fibers may be bundled (e.g., form fiber tows) and/or coated prior to inclusion within the matrix. The bundles of fibers may be impregnated with a slurry composition prior to forming the preform or after formation of the preform. The preform may then undergo thermal processing, and subsequent chemical processing to arrive at a component formed of a CMC material having a desired chemical composition. For example, the preform may undergo a cure or a burn-out to yield a high char residue in the preform, and subsequent melt-infiltration with silicon, or a cure or a pyrolysis to yield a silicon carbide matrix in the preform, and subsequent chemical vapor infiltration with silicon carbide. Additional steps may be taken to improve densification of the preform, either before or after chemical vapor infiltration, by injecting the preform with a liquid resin or a polymer followed by a thermal processing step to fill the voids with silicon carbide. CMC material as used herein may be formed using any known or hereafter developed methods including but not limited to melt infiltration, chemical vapor infiltration, polymer impregnation pyrolysis (PIP), or any combination thereof.

The term "metallic" as used herein is indicative of a material that includes metal such as, but not limited to, titanium, iron, aluminum, stainless steel, cobalt, and nickel alloys. A metallic material or an alloy can be a combination of at least two or more elements or materials, where at least one is a metal.

Gas turbine engines generally include a combustor, where a fuel and air are mixed and combusted, generating heat. In order to protect the combustor components from the high temperatures of the combustion gases, an insulating member, such as a heat shield or a liner panel is disposed between the high temperature combustion gases and the sensitive components, such as the fuel nozzles, the mixer assemblies, and structural members, including a dome and a liner shell. A liner may be segmented and comprise a plurality of liner panels. The insulating members define the combustion chamber. The structural members may generally be a metallic structure, while, in some cases, insulating members may be formed of a CMC material. In some cases, the dome or other structural members may also be formed of a CMC material. In connecting the insulating members and the structural members together, attachment configurations including fastened assemblies may generally be used, and gaps are present between the various components.

The attachment configurations and the fastened assemblies may include metallic fasteners such as bolts. Reduction in the functional thickness, such as holes, recesses, counterbores, and the like, in order to assemble the fastened assembly, contributes to heat transfer through the insulating member, reducing the insulating performance of the insulating member. Also, during operation of the gas turbine engine, metallic fasteners provide a conductive pathway for heat transfer from the combustion chamber to the structural member. Including an insulating material in the attachment configuration reduces the heat transfer through the attachment configuration. The present disclosure provides an attachment configuration without reduction in the functional thickness, without metallic fasteners within or through the functional thickness of the insulating member, and with insulating material to reduce heat transfer therethrough.

In combustors that implement CMC insulating members, while the structural member is metallic, the use of the CMC materials, which have a lower coefficient of thermal expansion than metallic materials, results in the relative motion between CMC insulating members and metallic structural members. By implementing an attachment configuration that allows for relative motion, internal stresses that are caused by otherwise constrained thermal growth, may be reduced. The present disclosure provides an attachment configuration for attaching an insulating member of the combustor to a structural member of the combustor with a fastened assembly, allowing for relative motion between the insulating member and the structural member.

Figure 2:
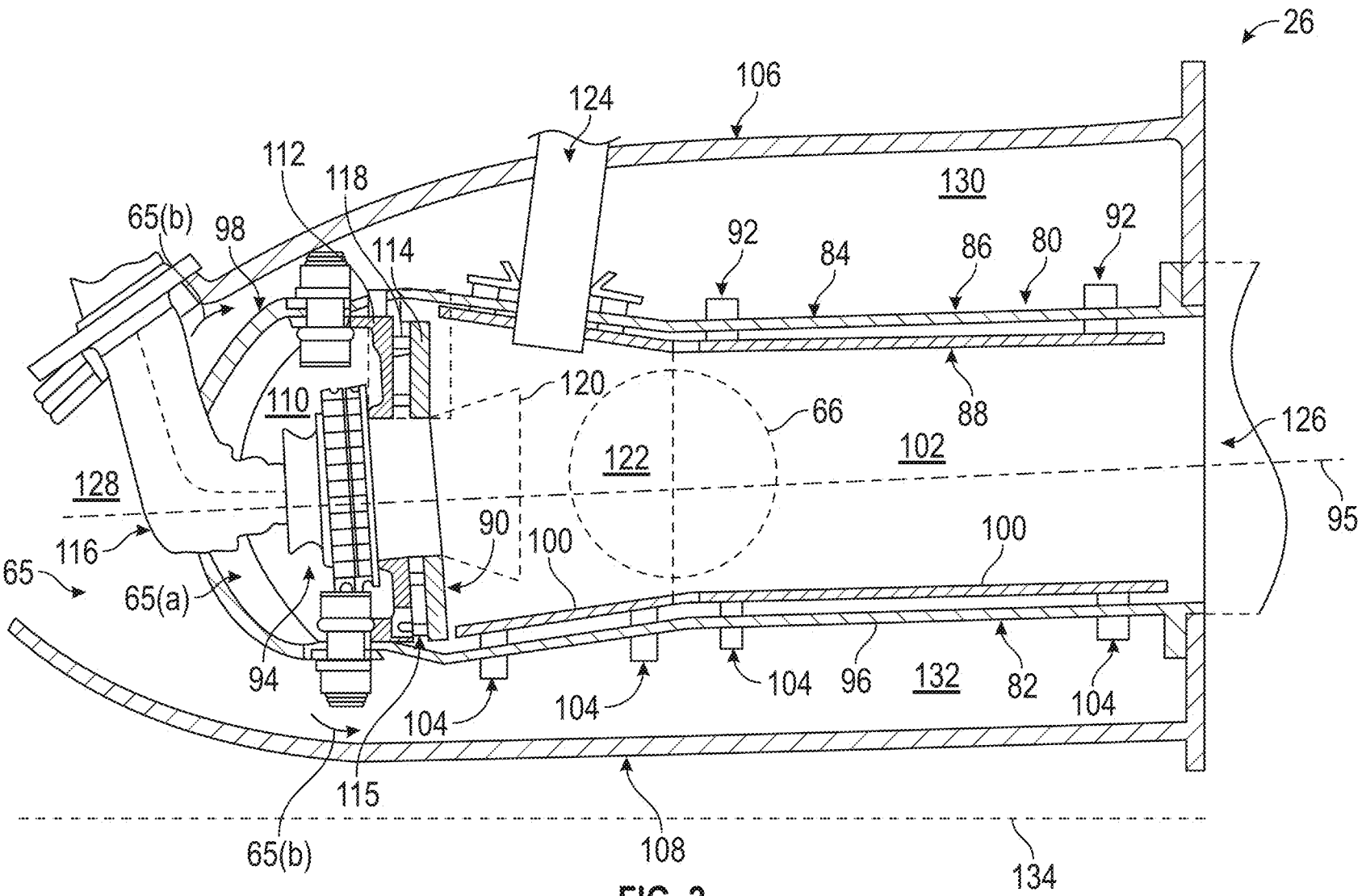
FIG. 2 is a schematic cross-sectional view of a combustor, taken along a combustor longitudinal centerline axis, according to the present disclosure.

In the description that follows, relative to a turbine engine 10 of FIG. 1 and a combustor 26 of FIGS. 1 and 2, the terms "axial" and "axially" refer to directions and orientations that extend substantially parallel to a longitudinal centerline axis 12 of the turbine engine 10. Moreover, the terms "radial" and "radially" refer to directions and orientations that extend substantially perpendicular to the longitudinal centerline axis 12 of the turbine engine 10. In addition, as used herein, the terms "circumferential" and "circumferentially" refer to directions and orientations that extend arcuately about the longitudinal centerline axis 12 of the turbine engine 10.

Referring now to the drawings, FIG. 1 is a schematic cross-sectional diagram of a turbine engine 10, taken along the longitudinal centerline axis 12 of the turbine engine 10, according to an embodiment of the present disclosure. As shown in FIG. 1, the turbine engine 10 defines an axial direction A (extending parallel to the longitudinal centerline axis 12 provided for reference) and a radial direction R that is normal to the axial direction A. In general, the turbine engine 10 includes a fan section 14 and a turbo-engine 16 disposed downstream from the fan section 14.

The turbo-engine 16 includes, in serial flow relationship, a compressor section 21, a combustor, also referred to as a combustor 26, and a turbine section 27. The turbo-engine 16 is substantially enclosed within an outer casing 18 that is substantially tubular and defines an annular inlet 20 that is annular about the longitudinal centerline axis 12. As schematically shown in FIG. 1, the compressor section 21 includes a booster or a low pressure (LP) compressor 22 followed downstream by a high pressure (HP) compressor 24. The combustor 26 is downstream of the compressor section 21. The turbine section 27 is downstream of the combustor 26 and includes a high pressure (HP) turbine 28 followed downstream by a low pressure (LP) turbine 30. The turbo-engine 16 further includes a jet exhaust nozzle section 32 that is downstream of the turbine section 27, a high-pressure (HP) shaft 34 or a spool, and a low-pressure (LP) shaft 36. The HP shaft 34 drivingly connects the HP turbine 28 to the HP compressor 24. The HP turbine 28 and the HP compressor 24 rotate in unison through the HP shaft 34. The LP shaft 36 drivingly connects the LP turbine 30 to the LP compressor 22. The LP turbine 30 and the LP compressor 22 rotate in unison through the LP shaft 36. The compressor section 21, the combustor 26, the turbine section 27, and the jet exhaust nozzle section 32 together define a core air flow path.

For the embodiment depicted in FIG. 1, the fan section 14 includes a fan 38 (e.g., a variable pitch fan) having a plurality of fan blades 40 coupled to a disk 42 in a spaced apart manner. As depicted in FIG. 1, the fan blades 40 extend outwardly from the disk 42 generally along the radial direction R. In the case of a variable pitch fan, the plurality of fan blades 40 are rotatable relative to the disk 42 about a pitch axis P by virtue of the fan blades 40 being operatively coupled to an actuation member 44 configured to collectively vary the pitch of the fan blades 40 in unison. The fan blades 40, the disk 42, and the actuation member 44 are together rotatable about the longitudinal centerline axis 12 via a fan shaft 45 that is powered by the LP shaft 36 across a power gearbox, also referred to as a gearbox assembly 46. In this way, the fan 38 is drivingly coupled to, and powered by, the turbo-engine 16, and the turbine engine 10 is an indirect drive engine. The gearbox assembly 46 is shown schematically in FIG. 1. The gearbox assembly 46 is a reduction gearbox assembly for adjusting the rotational speed of the fan shaft 45 and the fan 38, relative to the LP shaft 36, when power is transferred from the LP shaft 36 to the fan shaft 45.

Referring still to the exemplary embodiment of FIG. 1, the disk 42 is covered by a fan hub 48 that is aerodynamically contoured to promote an airflow through the plurality of fan blades 40. In addition, the fan section 14 includes an annular fan casing or a nacelle 50 that circumferentially surrounds the fan 38 and at least a portion of the turbo-engine 16. The nacelle 50 is supported relative to the turbo-engine 16 by a plurality of outlet guide vanes 52 that are circumferentially spaced about the nacelle 50 and the turbo-engine 16. Moreover, a downstream section 54 of the nacelle 50 extends over an outer portion of the turbo-engine 16, and, with the outer casing 18, defines a bypass airflow passage 56 therebetween.

During operation of the turbine engine 10, a volume of air 58 enters the turbine engine 10 through an inlet 60 of the nacelle 50 or the fan section 14. As the volume of air 58 passes across the fan blades 40, a first portion of air, also referred to as bypass air 62 is routed into the bypass airflow passage 56, and a second portion of air, also referred to as core air 64, is routed into the upstream section of the core air flow path through the annular inlet 20 of the LP compressor 22. The ratio between the bypass air 62 and the core air 64 is commonly known as a bypass ratio. The pressure of the core air 64 is then increased, generating compressed air 65. The compressed air 65 is routed through the HP compressor 24 and into the combustor 26, where the compressed air 65 is mixed with fuel and ignited to generate combustion gases 66.

The combustion gases 66 are routed into the HP turbine 28 and expanded through the HP turbine 28 where a portion of thermal energy or kinetic energy from the combustion gases 66 is extracted via one or more stages of HP turbine stator vanes 68 and HP turbine rotor blades 70 that are coupled to the HP shaft 34. This causes the HP shaft 34 to rotate, supporting operation of the HP compressor 24 (self-sustaining cycle). In this way, the combustion gases 66 do work on the HP turbine 28. The combustion gases 66 are then routed into the LP turbine 30 and expanded through the LP turbine 30. Here, a second portion of the thermal energy or the kinetic energy is extracted from the combustion gases 66 via one or more stages of LP turbine stator vanes 72 and LP turbine rotor blades 74 that are coupled to the LP shaft 36. This causes the LP shaft 36 to rotate, supporting operation of the LP compressor 22 (self-sustaining cycle) and rotation of the fan 38 via the gearbox assembly 46. In this way, the combustion gases 66 do work on the LP turbine 30.

The combustion gases 66 are subsequently routed through the jet exhaust nozzle section 32 of the turbo-engine 16 to provide propulsive thrust. Simultaneously, the bypass air 62 is routed through the bypass airflow passage 56 before being exhausted from a fan nozzle exhaust section 76 of the turbine engine 10, also providing propulsive thrust. The HP turbine 28, the LP turbine 30, and the jet exhaust nozzle section 32 at least partially define a hot gas path 78 for routing the combustion gases 66 through the turbo-engine 16.

The turbine engine 10 includes a fuel system that provides fuel to the combustor 26. The fuel is mixed with the compressed air 65 from the HP compressor 24 and ignited in the combustor 26 to produce the combustion gases 66. The fuel system may include a fuel tank or a fuel supply for storing the fuel therein, a fuel supply line, and a fuel injector. The fuel is provided from the fuel tank, along the fuel supply line to the fuel injector, which introduces the fuel into the combustor 26. The fuel system may include one or more flow control devices or valves along the fuel supply line for controlling an amount of the fuel provided to the combustor 26. The fuel injector may be provided at a forward end of the combustor 26. Accordingly, fuel provided along the fuel supply line is provided at a forward end of the combustor 26.

The turbine engine 10 depicted in FIG. 1 is by way of example only. In other exemplary embodiments, the turbine engine 10 may have any suitable configurations. For example, in other exemplary embodiments, the fan 38 may be configured in another suitable manner (e.g., as a fixed pitch fan) and further may be supported using any other suitable fan frame configuration. The turbine engine 10 may also be a direct drive engine, which does not have a power gearbox. The fan speed is the same as the LP shaft speed for a direct drive engine.

Moreover, in other exemplary embodiments, any other suitable number or configuration of compressors, turbines, shafts, or a combination thereof may be provided. In still other exemplary embodiments, aspects of the present disclosure may be incorporated into any other suitable turbine engine, such as, for example, turbofan engines, propfan engines, turbojet engines, turboprop, or turboshaft engines.

FIG. 2 is a cross-sectional side view of the combustor 26 of the turbo-engine 16 as shown in FIG. 1. As shown in FIG. 2, the combustor 26 may generally include a combustor liner 80 having an inner liner 82 and an outer liner 86, and a dome assembly 90, together defining a combustion chamber 102. Both the inner liner 82 and the outer liner 86 may extend circumferentially about a combustor longitudinal centerline axis 134, which may correspond to the longitudinal centerline axis 12 of the turbine engine 10 (FIG. 1). The inner liner 82 and the outer liner 86 are connected to a cowl 98, and a pressure plenum 110 is defined between the cowl 98, the inner liner 82, the outer liner 86, and the dome assembly 90. The combustor 26 also includes a mixer assembly 94 that is connected to a fuel nozzle assembly 116, with a mixer assembly axis 95. While FIG. 2 depicts a single mixer assembly 94 and a single fuel nozzle assembly 116, a plurality of mixer assemblies 94 and respective fuel nozzle assemblies 116 may be included in the combustor 26, where each respective mixer assembly 94 and fuel nozzle assembly 116 are circumferentially spaced about the combustor longitudinal centerline axis 134.

As shown in FIG. 2, the inner liner 82 is encased within an inner casing 108 and the outer liner 86 is encased within an outer casing 106. An outer flow passage 130 is defined between the outer liner 86 and the outer casing 106, and an inner flow passage 132 is defined between the inner liner 82 and the inner casing 108. Both the outer casing 106 and the inner casing 108 may extend circumferentially about the combustor longitudinal centerline axis 134. The inner liner 82 and the outer liner 86 may extend from the dome assembly 90 to a turbine nozzle 126 at an entry to the HP turbine 28 (FIG. 1), at least partially defining a hot gas path between the combustor liner 80 and the HP turbine 28. The combustion chamber 102 may more specifically define a primary combustion zone 122 at which an initial chemical reaction of a fuel-oxidizer mixture 120 occurs to generate the combustion gases 66, and/or where recirculation of the combustion gases 66 may occur before the combustion gases 66 flow further downstream within the combustion chamber 102 and into the turbine nozzle 126 at the entry to the HP turbine 28 and the LP turbine 30 (FIG. 1). The outer liner 86 may be a multi-layer liner that includes an outer liner shell 84 and insulating members. The insulating members are outer liner panels 88 that are connected to the outer liner shell 84 via a plurality of outer liner shell-to-panel connecting members 92. Similarly, the inner liner 82 may be a multi-layer liner that includes an inner liner shell 96 and insulating members, where the insulating members are inner liner panels 100 that are connected to the inner liner shell 96 via a plurality of inner liner shell-to-panel connecting members 104.

As shown in FIG. 2, following the LP compressor 22 and the HP compressor 24, the compressed air 65 flows into the combustor 26, and pressurizes a diffuser cavity 128. A first portion of the compressed air 65, as indicated schematically by arrows 65(*a*), flows from the diffuser cavity 128 into the pressure plenum 110, where the air 65(*a*) is mixed by the mixer assembly 94 with fuel provided by the fuel nozzle assembly 116. The fuel-oxidizer mixture 120 is then injected to the combustion chamber 102 by the mixer assembly 94. The fuel-oxidizer mixture 120 is ignited by an ignitor 124 and burned to generate the combustion gases 66 within the primary combustion zone 122 of the combustion chamber 102. Typically, the LP compressor 22 (FIG. 1) and the HP compressor 24 (FIG. 1) provide more compressed air 65 to the diffuser cavity 128 than is needed for combustion. Therefore, a second portion of the compressed air 65, as indicated schematically by arrows 65(*b*), may be used for various purposes other than combustion. For example, as shown in FIG. 2, a portion of the air 65(*b*) may be routed into the outer flow passage 130, and another portion of the compressed air 65(*b*) may be routed into the inner flow passage 132. In addition, or in the alternative, at least a portion of the compressed air 65(*b*) may be routed out of the diffuser cavity 128 for other purposes, such as to provide cooling air to at least one of the HP turbine 28 (FIG. 1) or the LP turbine 30 (FIG. 1).

Referring back to FIGS. 1 and 2 collectively, the combustion gases 66 generated in the combustion chamber 102 flow through the turbine nozzle 126 and into the HP turbine 28, thus causing the HP shaft 34 to rotate, supporting operation of the HP compressor 24. As shown in FIG. 1, the combustion gases 66 are then routed through the LP turbine 30, thus causing the LP shaft 36 to rotate, supporting operation of the LP compressor 22 and/or rotation of the fan shaft 45. The combustion gases 66 are then exhausted through the jet exhaust nozzle section 32 of the turbo-engine 16 to provide propulsion at the downstream end.

Referring again to FIG. 2, in addition, as will be described in more detail below, the dome assembly 90 includes a dome 112 and a heat shield 114 connected to the dome 112 via one or more dome heat shield connectors 118. During combustion of the fuel-oxidizer mixture 120, heat is generated. This heat is greatest in the upstream end of the combustion chamber 102, proximate the mixer assembly 94 and the fuel nozzle assembly 116. The heat shield 114 is an insulating member connected to the dome 112 to thermally protect the mixer assembly 94, the fuel nozzle assembly 116, the dome assembly 90, and other adjacent components from the heat and high temperatures of the combustion gases 66 in the combustion chamber 102. The heat shield 114 may be constructed from a ceramic matrix composite (CMC) material, or any other appropriate thermally insulating material, to inhibit the transfer of heat from the high-heat area of the combustion chamber 102 to other components of the combustor 26. The one or more dome heat shield connectors 118 may be metallic and, as such, far better conductors of heat, relative to the heat shield 114. Use of such metallic dome heat shield connectors 118 provides a potential pathway for conductive heat transfer beyond the heat shield 114, to the dome assembly 90 and proximate the mixer assembly 94 and the fuel nozzle assembly 116.

The mixer assembly 94 redirects a portion of the air 65(*a*) through the mixer assembly 94, forward of the heat shield 114, and eventually into the combustion chamber 102. This portion of air 65(*a*) does not mix with the fuel to form the fuel-oxidizer mixture 120, but instead flows through a gap 115 between the heat shield 114 and the dome 112, and into the combustion chamber 102, conductively transferring heat from the gap 115 to the combustion chamber 102, and, thus, further reducing the heat transfer to the dome 112.

In the description that follows, relative to the various liner mounting assemblies of FIGS. 3A to 8C, the terms "axial" and "axially" refer to directions and orientations that extend substantially parallel to the combustor longitudinal centerline axis 134. Moreover, the terms "radial" and "radially" refer to directions and orientations that extend substantially perpendicular to the combustor longitudinal centerline axis 134. In addition, as used herein, the terms "circumferential" and "circumferentially" refer to directions and orientations that extend arcuately about the combustor longitudinal centerline axis 134.

FIGS. 3A to 8C describe exemplary liner mounting assemblies 300, 400, 500, 600, 700, and 800. The liner mounting assemblies 300, 400, 500, 600, 700, and 800 may attach a liner panel 302, 402, 502, 602, 702, and 802 to a shell 304, 404, 504, and 604, also referred to herein as a liner shell. The description of the liner mounting assemblies 300, 400, 500, 600, 700, and 800 may alternatively be applied elsewhere to the combustor 26 (FIG. 2) such as, for example, as a dome-heat shield mounting assembly. In such embodiments, the following descriptions of the liner panels 302, 402, 502, 602, 702, and 802 may be applied to a heat shield (e.g., FIG. 2, heat shield 114) and the following descriptions of the shells 304, 404, 504, and 604 may be applied to a dome (e.g., FIG. 2, dome 112). Accordingly, in the description that follows, the liner panels 302, 402, 502, 602, 702, and 802, are also referred to as insulating members and the shells 304, 404, 504, and 604 are also referred to as structural members. In examples of the dome-heat shield mounting assembly, the insulating member is the heat shield and the structural member is the dome.

Figure 3A:
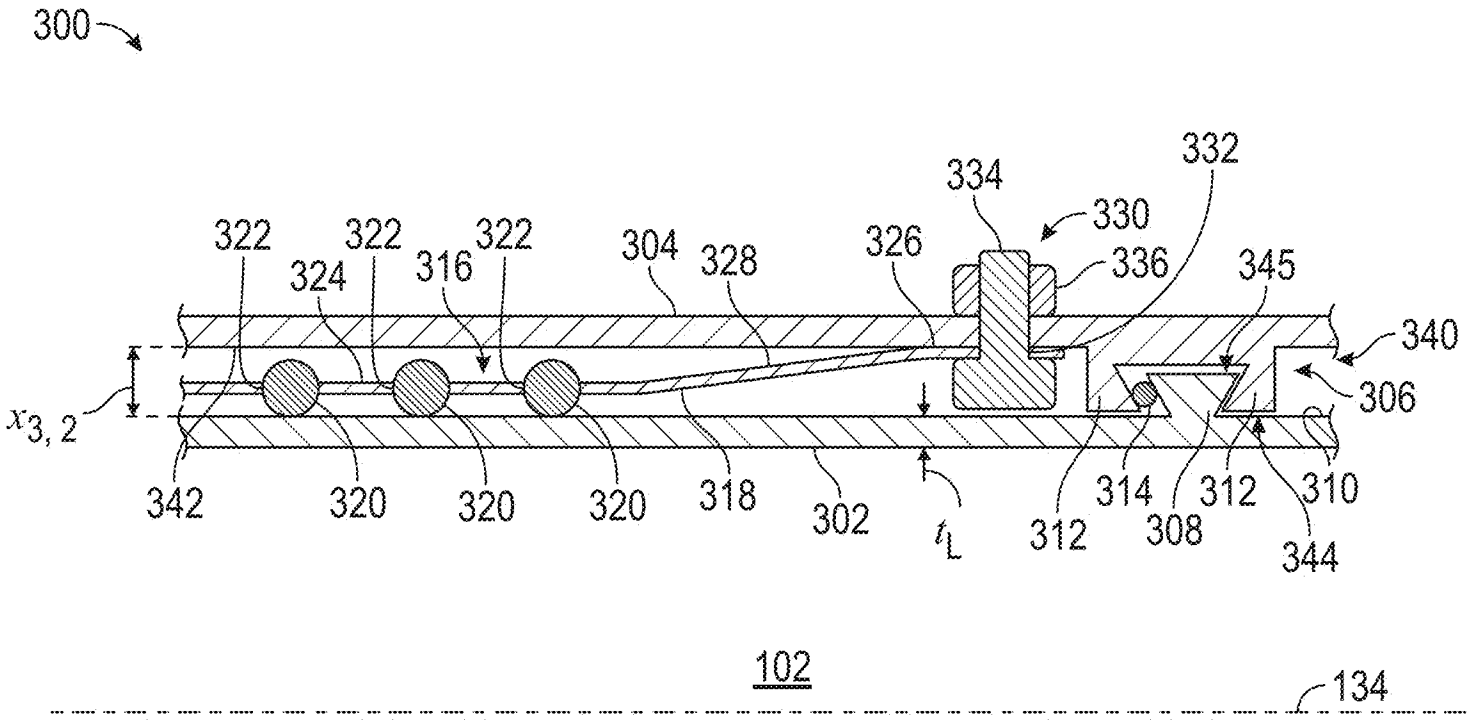
FIG. 3A is a partial cross-sectional view of a heat shield mounting assembly, taken along a combustor longitudinal centerline axis, according to the present disclosure.

FIG. 3A shows a partial schematic cross-section view of the liner mounting assembly 300 for attaching the liner panel 302 to the shell 304 with minimum pathways for heat transfer from the combustion chamber 102 to the shell 304. The liner panel 302 is connected to the shell 304 by one or more first attachment configurations, or dovetail joints 306 constraining the liner panel 302 relative to the shell 304 in three dimensions. Each dovetail joint 306 comprises a tail 308 protruding from an outer surface 310 of the liner panel 302, and a pin 312 protruding from the shell 304. A rotational constraint, with respect to the combustor longitudinal centerline axis 134 is made through use of hard mechanical stops (not shown), that prevent rotation of the tail 308 beyond a prescribed tolerable angle of rotation about the combustor longitudinal centerline axis 134. The dovetail joint 306 provides a radial limit of travel for the liner panel 302, relative to the shell 304. The dovetail joint 306 is an attachment configuration and further includes a seal 314. The seal 314 may be an O-ring, a spline seal, or other such appropriate component, and provides compressive resistance between the tail 308 and the pin 312 of the dovetail joint 306. The seal 314 is mechanically compliant, in that the seal 314 is slightly compressible, such that the seal 314 consumes any lash or play between the tail 308 and the pin 312 in the assembled state. Additionally, the compressibility of the seal 314 allows for relative motion of the liner panel 302, relative to the shell 304, due to vibrations during operation of the turbine engine 10 (FIG. 1), due to differential thermal expansion between the liner panel 302 and the shell 304, or due to manipulation during assembly of the liner mounting assembly 300.

In the embodiment shown, the tail 308 is integral with the liner panel 302 and extends from the liner panel 302. The pin 312 is integral with the shell 304 and extends from the shell 304. An equivalent configuration includes the tail 308 integral with the shell 304 and extending from the shell 304, and the pin 312 integral with the liner panel 302 and extending from the liner panel 302.

The liner mounting assembly 300 further includes a second attachment configuration. The second attachment configuration includes a ball plate assembly 316. The ball plate assembly 316 includes a plate member 318 and a plurality of spherical ceramic balls 320 for constraining the liner panel 302 relative to the shell 304 in the radial dimension. In order to allow for flexibility in assembly and in operation, the plate member may be constructed of a metallic material, preferably, a spring steel. Each of the plurality of spherical ceramic balls 320 is assembled within one of an arrayed plurality of spherical cavities 322 in the plate member 318. The plate member 318 is generally Z-shaped in cross section, including a first portion 324 at one end, with respect to the combustor longitudinal centerline axis 134, a second portion 326 at an opposite end, and a transition portion 328 therebetween. The second portion 326 of the plate member 318 includes a plurality of mounting holes 332, each for assembling the ball plate assembly 316 to the shell 304 in one of a plurality of fastened assemblies 330, whereas the spherical ceramic balls 320, in the first portion 324, contact the liner panel 302.

Each fastened assembly 330 assembles the ball plate assembly 316 to the shell 304 and includes a bolt 334 and a nut 336 in a compressive bolted assembly configuration. Each fastened assembly 330 retains the ball plate assembly 316 relative to the shell 304 in the radial direction and in the axial direction with respect to the combustor longitudinal centerline axis 134. The fastened assemblies 330 retain the ball plate assembly 316 in the rotational direction, with respect to the combustor longitudinal centerline axis 134. Altogether, the fastened assemblies 330 fix the ball plate assembly 316, relative to the shell 304. Alternatively, the ball plate assembly 316 may be assembled to the shell 304 by one or more, rivets, screws, or other fasteners, or may be joined by welding, by adhesion, by metal forming, or by any other appropriate manner, as may be called for, for functional or manufacturing considerations, or any combination of fasteners and/or manners of joining.

Figure 3B:
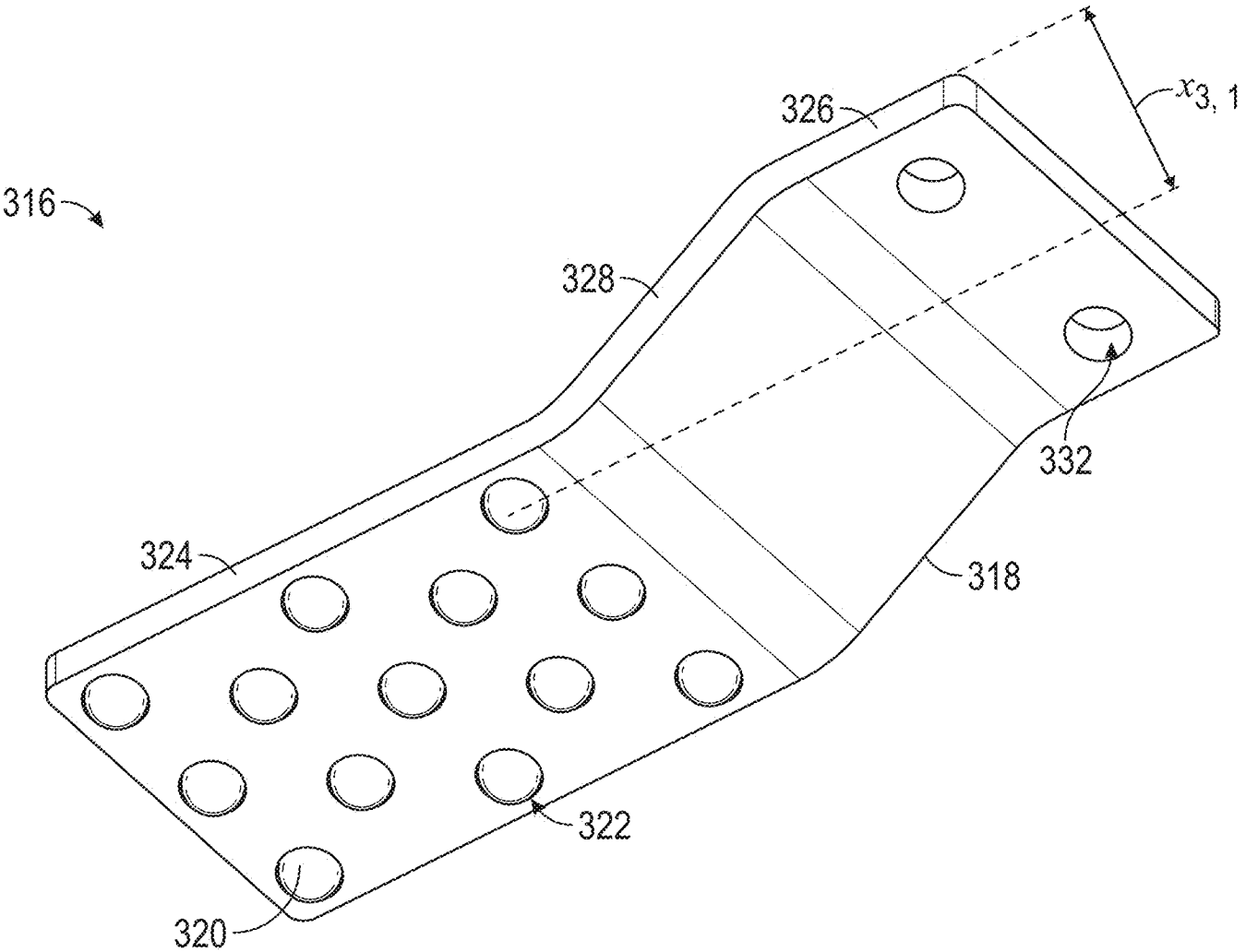
FIG. 3B is a schematic view of a spring plate, according to the present disclosure.

FIG. 3B is a schematic view of the ball plate assembly 316 according to the disclosure. As shown in FIG. 3B, the ball plate assembly 316 contains two mounting holes 332. The ball plate assembly 316 may alternatively include more or fewer than two mounting holes, and the liner mounting assembly 300 (FIG. 3A) may, therefore, include more or fewer than two dovetail joints 306 (FIG. 3A). The mounting holes 332 and the fastened assemblies 330 may be in any arrangement as may be determined, to optimize or to improve the assembly of the ball plate assembly 316 to the liner panel 302 (FIG. 3A), to improve maintenance of the liner mounting assembly 300, or to reduce cost.

In order to maintain the integrity of the dovetail joint 306 and to prevent undue stresses to the components including the liner panel 302, the shell 304, the tail 308, and the pin 312 of FIG. 3A, a compressive assembly must be maintained despite operational events that otherwise cause relative motion and cyclic stresses. Such operation events include flexing, vibration, fretting, or the like, of one or more of the individual components or of the liner mounting assembly 300. That is, the tail 308 must provide an inward-acting radial force on the pin 312 either through intimate contact between the tail 308 and the pin 312, or through the seal 314 (FIG. 3A), in all operational conditions. To maintain the radial force applied by the tail 308 on the pin 312, the ball plate assembly 316 applies an inward force on the liner panel 302 at the interface between the plurality of spherical ceramic balls 320 and the outer surface 310 (FIG. 3A) of the liner panel 302. The inward force is maintained, relative to the combustor longitudinal centerline axis 134 (FIG. 3A), despite relative radial motion, deformation, or vibration with respect to the combustor longitudinal centerline axis 134, due to flexibility of the ball plate assembly 316, and, more specifically, due to the flexibility of the plate member 318. In the free state, the ball plate assembly 316 has a radial dimension of $x_{3,1}$ from the second portion 326 to the spherical ceramic balls 320. Assembly of the ball plate assembly 316 into the liner mounting assembly 300 requires bending the plate member 318, reducing the radial dimension to $x_{3,2}$, less than the radial dimension $x_{3,1}$, and defined by the radial distance between an inner surface 342 of the shell 304 and the outer surface 310 of the liner panel 302. Due to the bending of the plate member 318, the ball plate assembly acts as a spring, applying an inward force on the outer surface 310 of the liner panel 302 and applying an outward force on the inner surface 342 of the shell 304 at the fastened assemblies 330. Consequently, the tail 308 applies an outward force on the pin 312 and the seal 314. The bending of the plate member 318 is maintained, as the magnitude of the difference in the radial dimensions $x_{3,1}$ and $x_{3,2}$ is greater than the magnitude of any relative motion or relative deformation of the components of the liner-shell assembly.

As the function of the liner panel 302 is to provide thermal insulation between the high temperature combustion present in the combustion chamber 102 (FIG. 2) and the other components of the combustor 26 (FIG. 2), the liner panel 302 provides continuous insulation between the combustion chamber 102 and the other components of the combustor 26. The magnitude of thermal insulation provided by the liner panel 302 is directly proportional to the functional thickness $t_L$of the liner panel 302. The functional thickness $t_L$ is the thickness of the liner panel 302 in the generally radial direction, or the direction against which heat transfer is inhibited by the liner panel 302. The configuration of the liner mounting assembly 300 allows for the functional thickness $t_L$ to be maintained throughout, without voids or reductions in functional thickness $t_L$, preserving the thermal insulation performance of the liner panel 302. Additionally, the configuration of the liner mounting assembly provides for assembly of the liner panel 302 to the shell 304 without the penetration of any thermally conductive elements, such as, for example, metallic fasteners, through the liner panel 302. Such penetration would allow for some quantity of heat transfer from the combustion chamber 102 to the combustor 26, through the fastener.

When present, a portion of the air 65(*a*), flowing through a gap 340 between the liner panel 302 and the shell 304, convectively transfers heat from the outer surface 310 of the liner panel 302. This flow of the portion of air 65(*a*) maintains a cooler temperature in the gap 340, than an otherwise equivalent combustor 26 (FIG. 2) without the flow of the portion of air 65(*a*).

The temperature of the outer surface 310 of the liner panel 302 is greater than the temperature of the shell 304. To minimize conductive heat transfer from the liner panel 302 to the shell 304, the spherical ceramic balls 320 are constructed from a thermally insulating ceramic material. The spherical ceramic balls 320 each makes substantially point contact with the liner panel 302, minimizing the path of heat transfer from the liner panel 302 to the shell 304. Exemplary materials for other components of the liner mounting assembly 300, such as the plate member 318, the shell 304, and the bolt 334 include many relatively conductive materials, such as metals. The inclusion of an insulator, such as the plurality of spherical ceramic balls 320, provides a barrier to an otherwise conductive path for heat transfer between the outer surface 310 of the liner panel 302 and the shell 304.

Returning to the dovetail joint 306, a clearance 344 is maintained between the outer surface 310 of the liner panel 302 and the pin 312, and a clearance 345 is maintained between the tail 308 and the pin 312, by virtue of the radially inward biasing force applied on the liner panel 302 by the ball plate assembly 316. The clearance 344 allows for the portion of air 65 (*a*) to flow between the pin 312 and the outer surface 310, thus minimizing heat transfer across the clearance 344. The seal 314 may be constructed of an insulating material such as a rubber, a composite, or any other suitable material, providing for mechanical compliance in the dovetail joint 306 as discussed, while reducing conductive heat transfer from the tail 308 to the pin 312. Contact is present between the tail 308 and the pin 312. However, the contact is both radially outside of the functional thickness $t_L$ of the liner panel 302 and is within the flow path of the portion of air 65(*a*) flowing through the gap 340. The flow of the portion of air 65(*a*) through the gap 340 convectively transfers heat from both the tail 308 and the pin 312, reducing the temperature of both, and reducing the heat transfer in the dovetail joint 306 from the tail 308 of the liner panel 302 to the pin 312 of the shell 304.

One ball plate assembly is shown in FIG. 3A. However, the liner mounting assembly 300 may contain a plurality of ball plate assemblies 316. The plurality of ball plate assemblies 316 may be arrayed circularly about the combustor longitudinal centerline axis 134 so as to provide symmetric net forces on the liner panel 302. Such a plurality of ball plate assemblies 316 may consist of two, four, or any other quantity of ball plate assemblies to provide the desired resultant net forces, or as aids in assembly. Similarly, the ball plate assembly 316 as shown in FIG. 3B, is generally rectangular in a two-dimensional plan view, viewed in the radial direction with respect to the combustor longitudinal centerline axis 134. To aid in force balance or to aid in assembly, the ball plate assembly may be any other simple or complex two-dimensional plan shape, including arcuate, circular, or ring-shaped, or may have a rectangular shape, but with different lengths, widths, or aspect ratio, from that of the ball plate assembly 316 shown in FIG. 3B.

Further, the ball plate assembly 316 as shown in FIG. 3B and applied to the liner mounting assembly 300, has a rectangular array of thirteen spherical ceramic balls 320, in alternating rows of three and two. The spherical ceramic balls 320 may be of any size and may or may not be equal in size to one another. The plurality of spherical ceramic balls 320 may include more or fewer than thirteen individual spherical ceramic balls 320, arranged in any useful array. Such configurations or reconfigurations may be made to optimize one or more considerations for performance, cost, manufacturability, or maintenance. Among the considerations are the force of the ball plate assembly 316 on the liner panel 302, the flow of the portion of air 65(*a*) through the gap 340 convectively transferring heat, the conductive heat transfer through the spherical ceramic balls 320, the manufacturing or assembly of the liner mounting assembly 300 or its constituent components, maintenance of the liner-shell assembly, or cost.

Figure 4A:
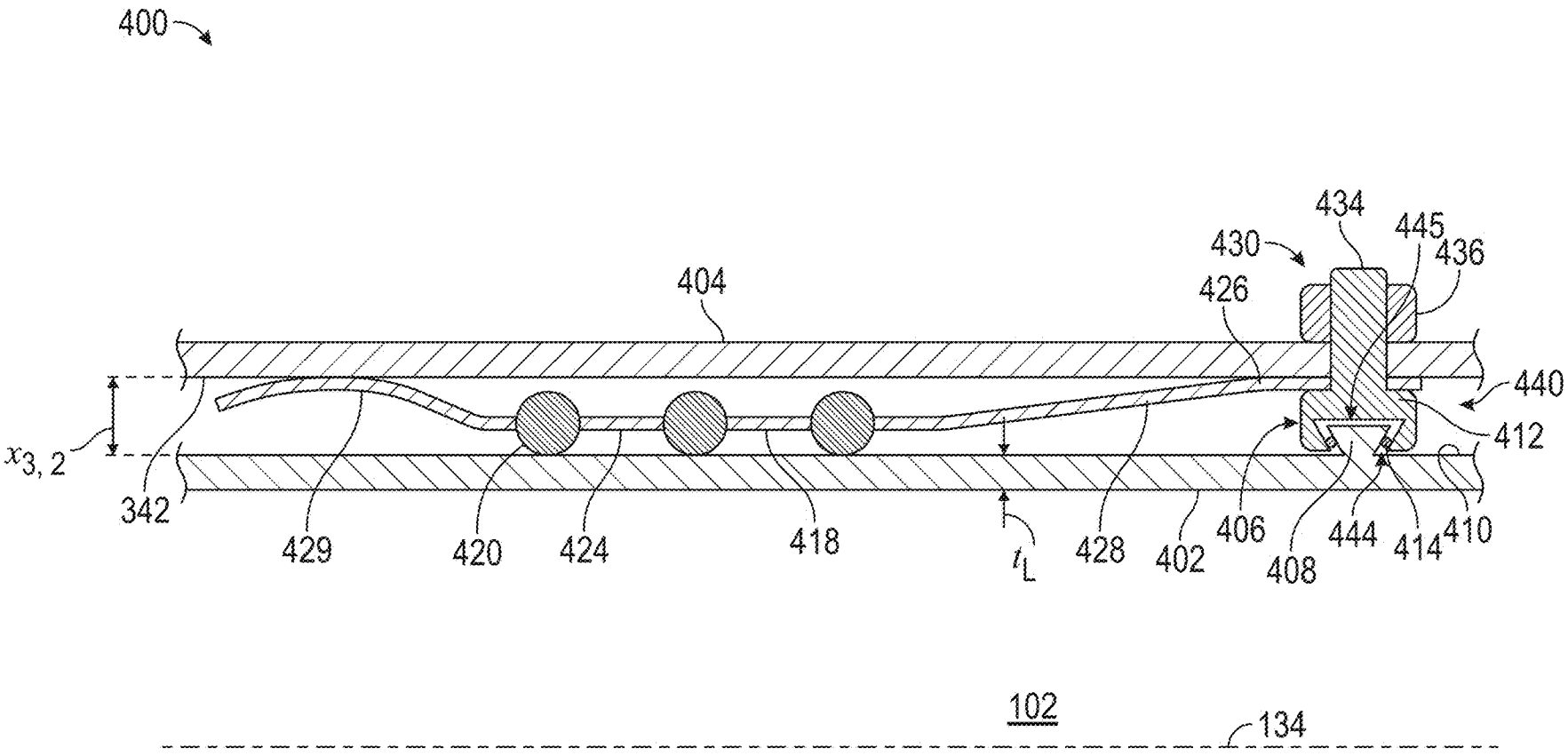
FIG. 4A is a partial cross-sectional view of a heat shield mounting assembly, taken along a combustor longitudinal centerline axis, according to the present disclosure.
Figure 4B:
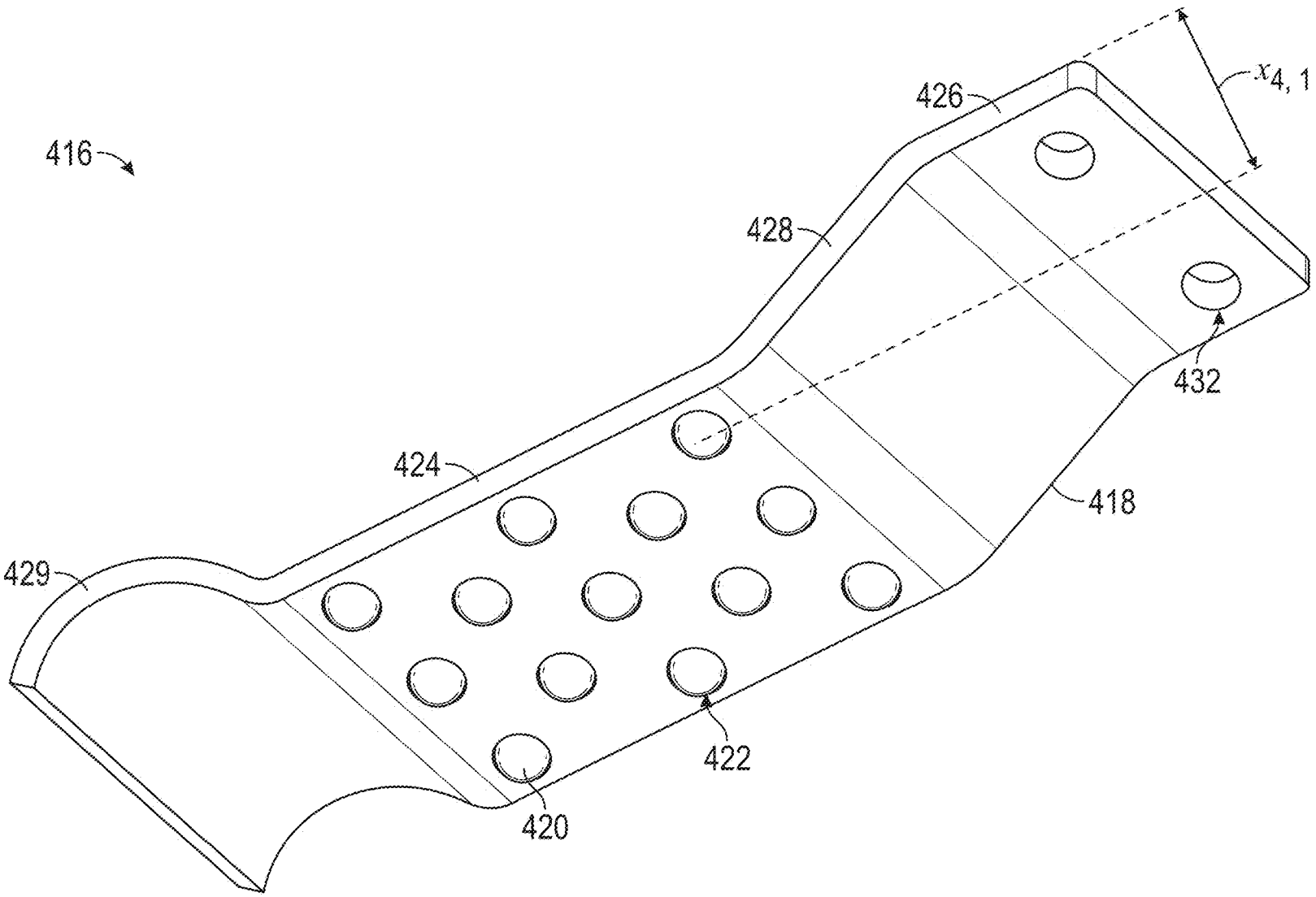
FIG. 4B is a schematic view of a spring plate, according to the present disclosure.

FIGS. 4A and 4B show a partial schematic cross-sectional view of the liner mounting assembly 400 for attaching the liner panel 402 to the shell 404 with minimum pathways for heat transfer from the combustion chamber 102 to the shell 404, and a ball plate assembly, respectively. The liner mounting assembly 400 and the ball plate assembly are substantially similar in function to the liner mounting assembly 300 and the ball plate assembly 316 as described with respect to FIGS. 3A and 3B, but with one or more differently configured fastened assemblies 430, including one or more dovetail joints 406 and a differently configured ball plate assembly 416. Elements of the description of the liner mounting assembly 300 similarly apply to the liner mounting assembly 400 and, as such, only the differences between the two are described. Likewise, elements of the ball plate assembly 316 similarly apply to the ball plate assembly 416 and, as such, only the differences between the two are described. The remaining description of the liner mounting assembly 300 and of the ball plate assembly 316 also applies to this embodiment and the remaining detailed description is omitted here.

The liner panel 402 is connected to the shell 404 through the fastened assembly 430, including the dovetail joint 406. The first attachment configuration, constraining the liner panel 402 relative to the shell 404 in three dimensions, is the dovetail joint 406. The dovetail joint 406, comprises a tail 408 protruding from an outer surface 410 of the heat shield, and a pin end 412 of a threaded fastener 434. The dovetail joint 406 further includes a seal 414 assembled to the tail 408, at the dovetailed interface between the tail 408 and the pin end 412.

Referring now collectively to FIGS. 4A and 4B, the liner mounting assembly 400 further includes a second attachment configuration in the form of the ball plate assembly 416, which serves to constrain the liner panel 402, relative to the shell 404, in the radial dimension. The ball plate assembly 416 includes a plate member 418 and a plurality of spherical ceramic balls 420 each assembled within one of an arrayed plurality of spherical cavities 422 in the plate member 418.

The plate member 418 includes a first portion 424, a second portion 426, and a transition portion 428 therebetween. The plate member additionally includes an arcuate portion 429, at one end, beyond the first portion 424, with respect to the combustor longitudinal centerline axis 134. A plurality of mounting holes 432 are provided for assembling the ball plate assembly 416 to the shell 404 with the one or more fastened assemblies 430.

As may be seen, the threaded fastener 434 as applied to the dovetail joint 406 additionally serves to fasten the ball plate assembly 416 to the shell 404 at the fastened assembly 430, reducing overall complexity of the liner mounting assembly 400 relative to the liner mounting assembly 300. A nut 436 threads onto the threaded fastener 434. The pin end 412 and the nut 436 fasten the plate member 418 and the shell 404 therebetween. As may be seen in FIG. 4A, the pin end 412 is integrated with threaded fastener 434 of the fastened assembly 430. Relative to the shell 304 of the liner mounting assembly 300 of FIG. 3A, the pin 312 is excluded from the shell 404, in favor of the pin end 412 of the threaded fastener 434, resulting in a simpler shaped shell 404, which may, in turn, result in simpler or lower cost manufacture, assembly, or maintenance. Additionally, the integration of the pin end 412 into the threaded fastener 434 may enable the use of a stronger material, relative to the pin 312 integrated into the shell 304.

The ball plate assembly 416 has a free state radial dimension $x_{4,1}$ between the second portion 426 and the plurality of spherical ceramic balls 420. The radial dimension is reduced to $x_{4,1}$ upon assembling the ball plate assembly 416 into the liner mounting assembly 400. This compression in the radial direction causes a bending or a flexing behavior in the plate member 418. The reaction forces from the bending of the plate member 418 causes the ball-plate assembly to apply a radially inward force against the outer surface 410 of the heat shield at the spherical ceramic balls 420. Additionally, the bending of the plate member 418 causes the ball plate assembly 416 to contact and to apply a radially outward force against the inner surface 342 of the shell 404 at both the second portion 426 and the arcuate portion 429.

The radially inward force of the ball plate assembly 416 on the liner panel 402, as assembled in the liner mounting assembly 400, ensures a radially inward force is applied by the tail 408 on the pin end 412, through the seal 414. The seal 414 is, therefore, mechanically compliant, able to absorb at least a portion of any relative deflection, or vibrations, between the tail 408 and the pin end 412.

Heat transfer between the liner panel 402 and the shell 404 is mitigated both by maintaining clearance between the liner panel 402 and the shell 404, and by the inclusion of insulating components in otherwise conductive pathways of the liner mounting assembly 400. Examples of insulating components providing barriers in otherwise conductive pathways of the liner mounting assembly 400 include the spherical ceramic balls 420 and the seal 414, installed between the liner panel 402 and the shell 404.

Heat transfer from the outer surface 410 of the liner panel 402 to the shell 404 is mitigated in part by maintaining the flow of the portion of air 65(*a*) through a gap 440 between the liner panel 402 and the shell 404, the portion of air 65(*a*) convectively transferring heat from the outer surface 410. The radially inward bias of the liner panel 402 and of the tail 408, applied by the bending of the plate member 418 as assembled, both maintains a clearance 444 between the outer surface 410 of the liner panel 402 and the pin end 412, and maintains a clearance 445 between the tail 408 and the pin end 412. As the threaded fastener may be constructed from a conductive material such as a metal, the clearance 444 maintained between the pin end 412 and the outer surface 410 of the liner panel 402 prevents directly conductive heat transfer from the outer surface 410 of the liner panel 402, to the threaded fastener 434 and subsequently to the shell 404. The seal 414, disposed between the liner panel 402 and the pin end 412 mitigates conductive heat transfer between the tail 408 and the threaded fastener 434 by offsetting the contact between the tail 408 and the pin end 412, maintaining the clearance 445, thus preventing direct conductive heat transfer between the tail 408 and the pin end 412. Additionally, the clearance 445 between the tail 408 and the pin end 412 allows for the flow of air 65 (*b*) through the gap 440 to additionally flow across and between the tail 408 and the pin end 412, convectively transferring heat away from the tail 408.

In the embodiment shown, the tail 408 is integral with the liner panel 402 and extends from the liner panel 402. The pin end 412 is integral with the threaded fastener 434. An equivalent configuration includes the tail 408 integral with the threaded fastener 434 and the pin end 412 integral with the liner panel 402, extending from the liner panel 402.

Figure 5:
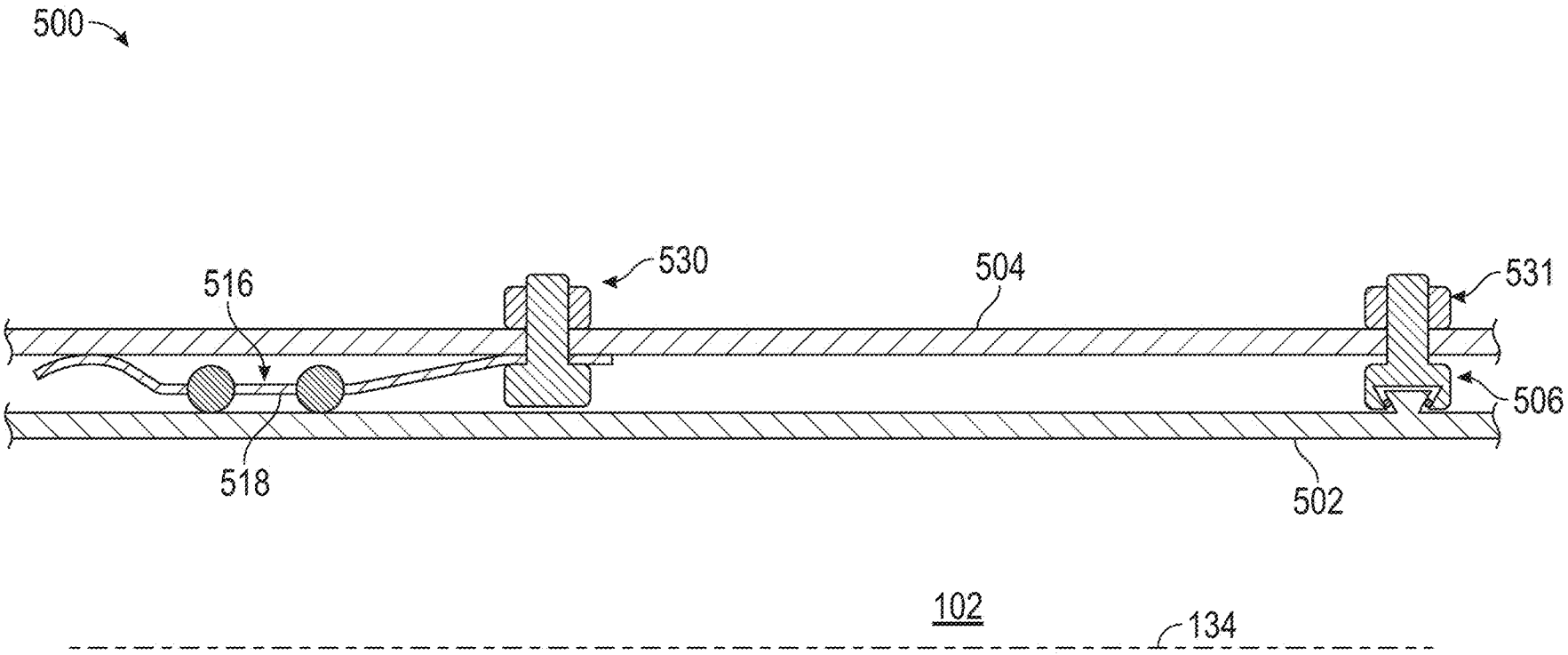
FIG. 5 is a partial cross-sectional view of a heat shield mounting assembly taken along a combustor longitudinal centerline axis, according to the present disclosure.

FIG. 5 illustrates a partial schematic cross-sectional view of the liner mounting assembly 500 with a combination of features as discussed with respect to the liner mounting assembly 300 of FIGS. 3A and 3B, and features as discussed with respect to the liner mounting assembly 400 of FIGS. 4A and 4B. For example, the liner mounting assembly 500 has a first fastened assembly 530, similar in configuration to the fastened assemblies 330 of the liner mounting assembly 300, for the purpose of assembling a ball plate assembly 516 to the shell 504. The ball plate assembly includes a plate member 518, which is bent relative to its free state shape, as assembled in the liner mounting assembly 500, to apply a radially inward force on the liner panel 502. Additionally, a second fastened assembly 531, similar in configuration to the fastened assembly 430, with an integrated dovetail joint 506, assembles the liner panel 502 to the shell 504. The first attachment configuration comprises the dovetail joint 506.

The configuration of the liner mounting assembly 500 allows for flexibility in design, relative to the liner mounting assembly 300 and the liner mounting assembly 400. As shown in FIG. 5, the presence of two separate assemblies allows for the second fastened assembly 531 to be located at a remote position relative to the first fastened assembly 530, should such positioning be advantageous for manufacture, for assembly, for maintenance or for cost of either the individual components or of the liner mounting assembly 500 as a whole. For example, the liner mounting assembly 500 allows for the removal and the replacement of the liner panel 502 without requiring removal of the ball plate assembly 516 from the liner mounting assembly 500.

Figure 6A:
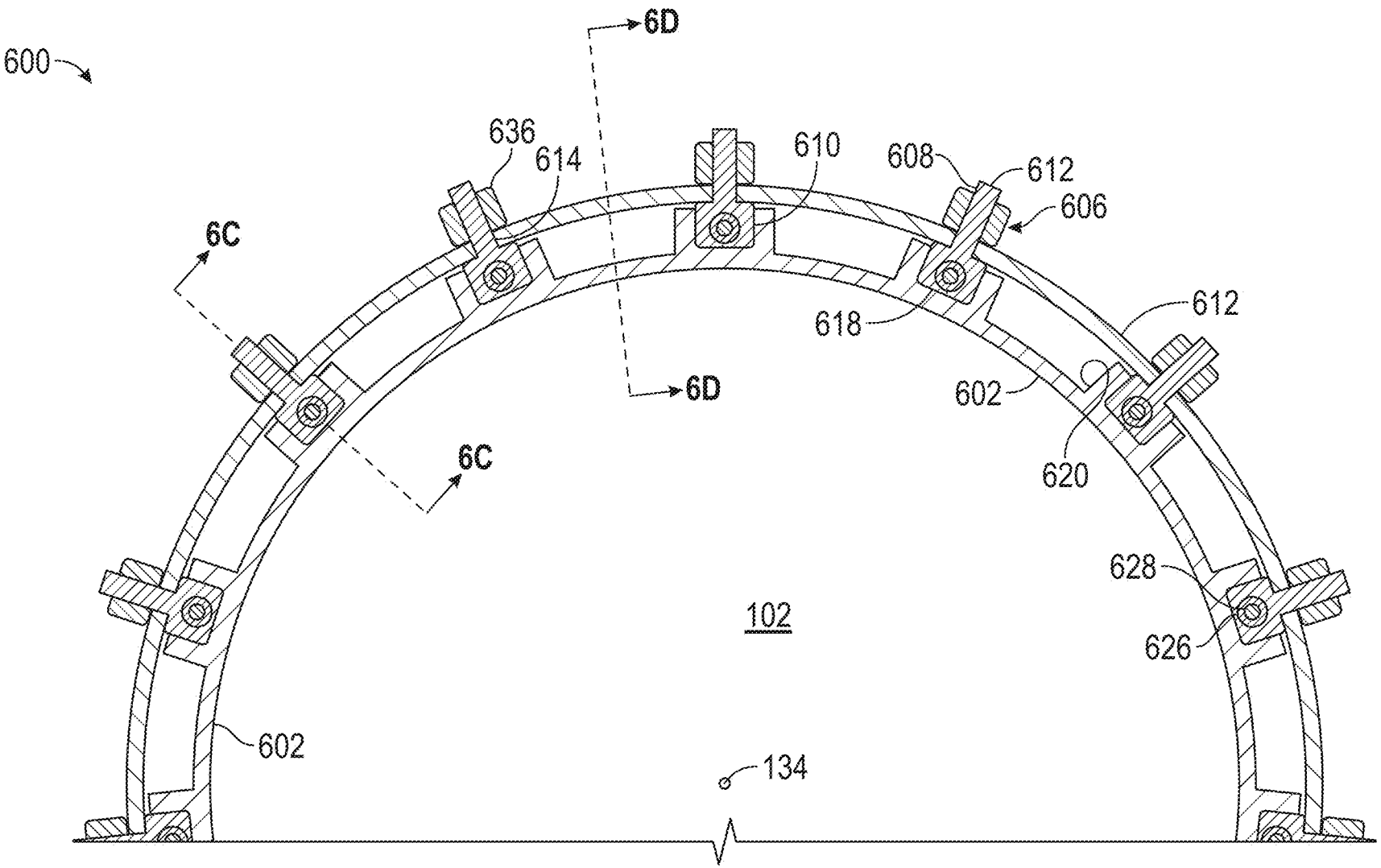
FIG. 6A is a partial cross-sectional view of a liner mounting assembly showing a plurality of first attachment configurations, taken orthogonally to a combustor longitudinal centerline axis, according to the present disclosure.

Referring now to the schematic cross-sectional view shown in FIG. 6A, the liner mounting assembly 600 includes the liner panel 602, assembled to the shell 604, arranged circumferentially about the combustor longitudinal centerline axis 134, as viewed in the longitudinal direction, at an aft end of a combustor. The liner panel 602 is assembled to the shell 604 at a plurality of fastened assemblies 606. The fastened assemblies 606 are a first attachment configuration arranged circumferentially about the combustor longitudinal centerline axis 134, constraining the liner panel 602 relative to the shell 604, in all dimensions.

Figure 6B:
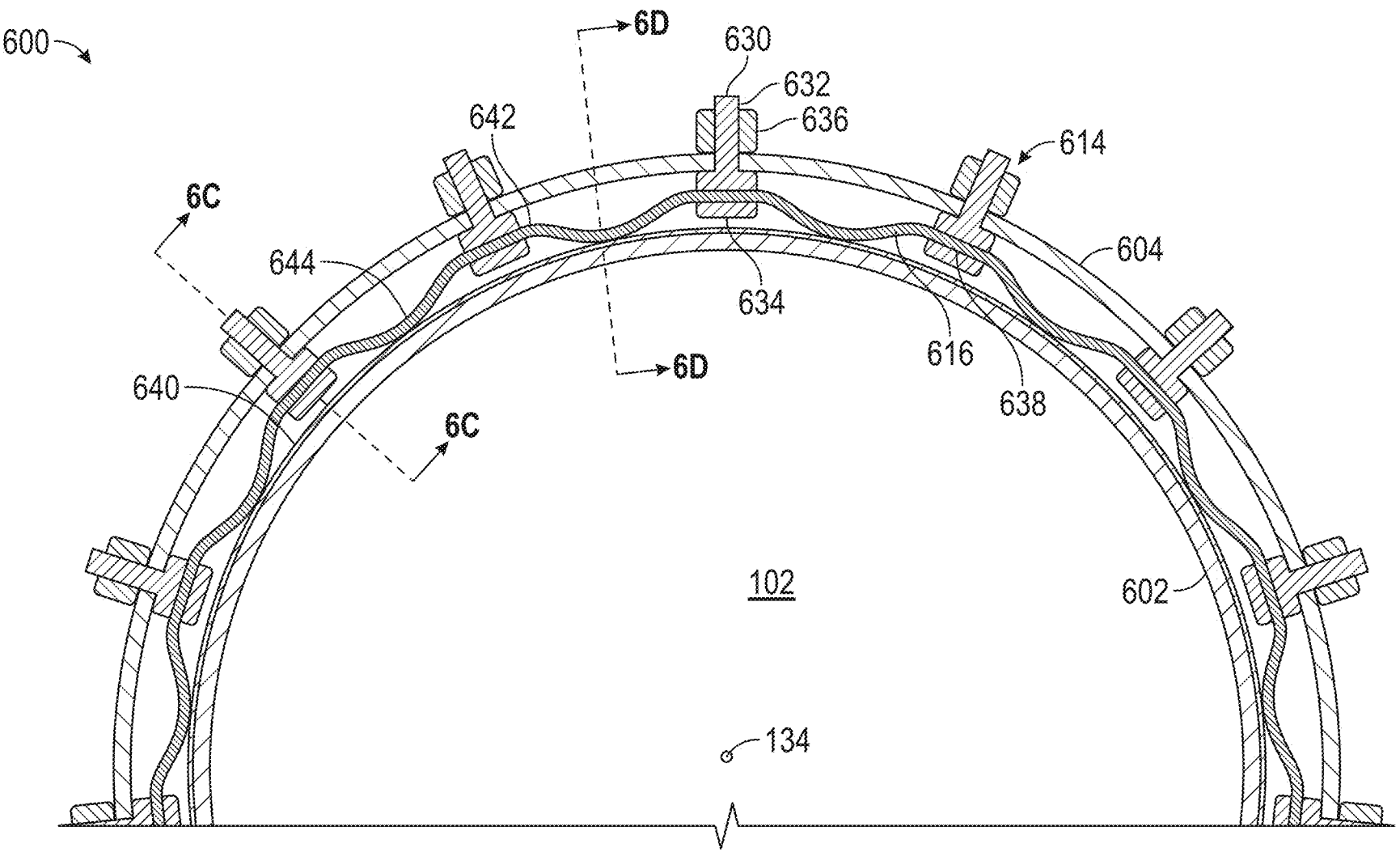
FIG. 6B is a partial cross-sectional view of a liner mounting assembly showing a plurality of second attachment configurations, taken orthogonally to a combustor longitudinal centerline axis, according to the present disclosure.

FIG. 6B shows a partial schematic cross-sectional view of the liner mounting assembly 600, including a plurality of the liner panels 602, the shell 604, and a plurality of fastened assemblies 614 for fastening the plurality of liner panels 602 to the shell 604, as viewed in the longitudinal direction, at a forward end of a combustor, with respect to the combustor longitudinal centerline axis 134. The fastened assemblies 614 are a second attachment configuration arranged circumferentially about the combustor longitudinal centerline axis 134 for constraining the liner panel 602, relative to the shell 604, in the radial dimension.

Figure 6C:
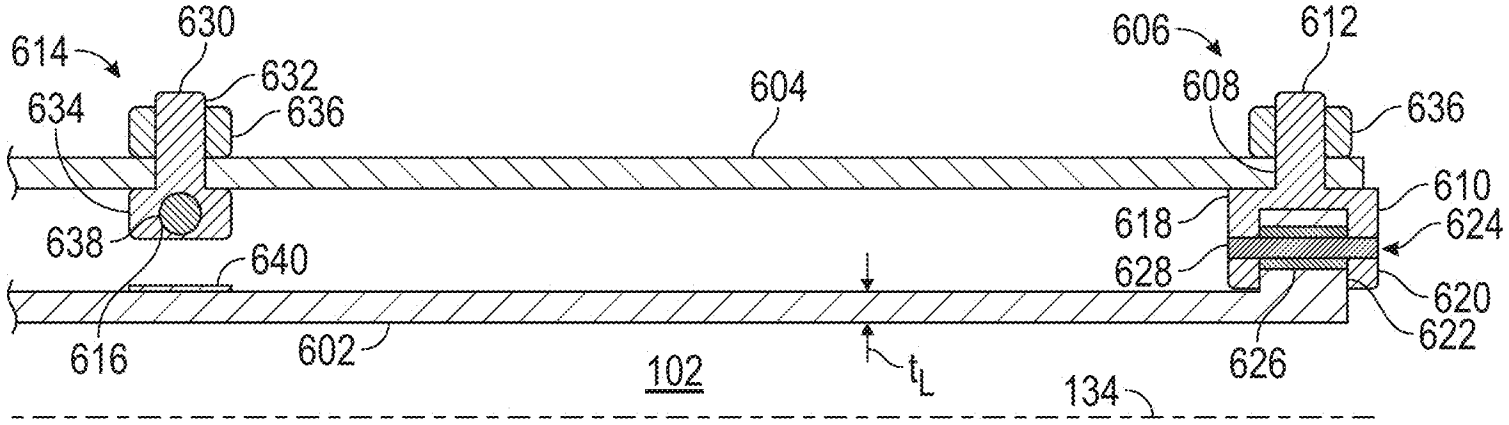
FIG. 6C is a partial cross-sectional view of a liner mounting assembly, taken at section 6C-6C as shown in FIGS. 6A and 6B, according to the present disclosure.
Figure 6D:
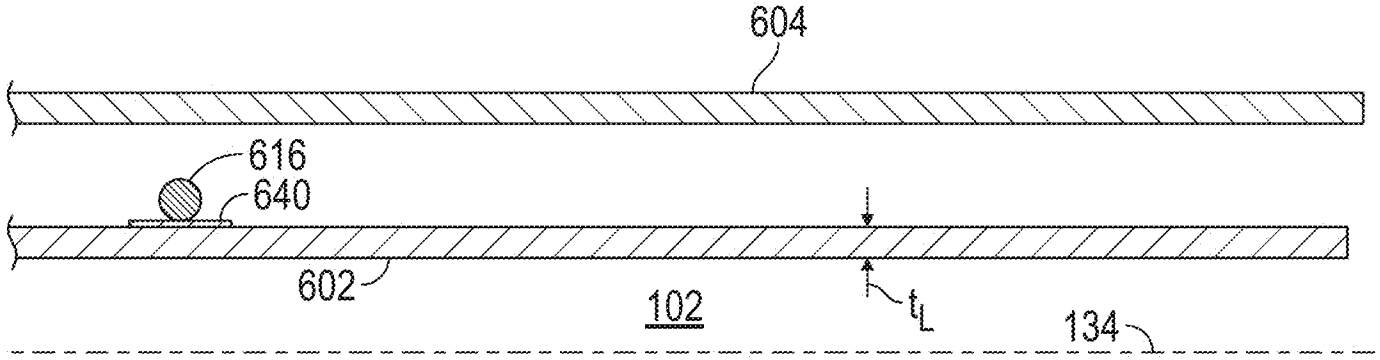
FIG. 6D is a partial cross-sectional view of a liner mounting assembly, taken at section 6D-6D as shown in FIGS. 6A and 6B, according to the present disclosure.

FIG. 6C shows a partial schematic cross-sectional view of the liner mounting assembly 600 as viewed in the circumferential direction, taken at section 6C-6C, shown in FIGS. 6A and 6B, and FIG. 6D shows a partial cross-sectional schematic view of the liner mounting assembly 600 as viewed in the circumferential direction, taken at section 6D-6D, shown in FIGS. 6A and 6B.

Referring collectively to the FIGS. 6A to 6D, each of the plurality of liner panels 602 is affixed to the shell 604 at the aft end by the fastened assembly 606, which retains the liner panel 602 radially, rotationally, and axially. Each of the plurality of liner panels 602 is constrained radially by, and maintained in concentric alignment with, a spline hoop 616. The spline hoop 616 is in turn constrained radially, and maintained in concentric alignment with, the shell 604 by the fastened assemblies 614. The spline hoop 616 allows for thermal growth and/or local relative movement of the liner panel 602 relative to the shell 604 in the rotational and axial directions, with respect to the combustor longitudinal centerline axis 134, while maintaining alignment of the liner panels 602 to the shell 604. Such degrees of freedom are necessary at the forward end of the combustor 26, nearest the mixer assembly 94 and the highest heat region of the combustion chamber 102, to compensate for thermal growth of the liner panel 602 and movement or vibration caused by operation of the turbine engine 10.

The magnitude of thermal insulation provided by the liner panel 602 is directly proportional to the functional thickness $t_L$ of the liner panel 602. The functional thickness $t_L$ is the thickness of the liner panel 602 in the generally radial direction, or the direction against which heat transfer is inhibited by the liner panel 602. The configuration of the liner mounting assembly 600 allows for the functional thickness $t_L$ to be maintained throughout, without voids or reductions in functional thickness $t_L$, preserving the thermal insulation performance of the liner panel 602.

The fastened assembly 606 includes a threaded fastener 608, with a threaded end 612 and a saddle end 610. The threaded end 612 of the threaded fastener 608 is assembled through a mounting hole in the shell 604 and is retained with a nut 636. The saddle end 610 of the threaded fastener 608 includes a forward tab 618 and an aft tab 620 positioned forward and aft of a block feature 622 of the liner panel 602, collectively constraining the liner panel 602 in the forward direction and the aft direction, respectively.

To constrain the rotation and the radial movement of the block feature 622 relative to the threaded fastener 608 and, therefore, to constrain the rotation and the radial movement of the liner panel 602 relative to the shell 604, a pinned joint 624 is assembled through axially aligned holes in the forward tab 618, the aft tab 620, and the block feature 622. An annular metallic insert 626 is press fit into the block feature 622. The insert 626 is sized to have an interference fit in the block feature 622, such that the insert 626 is fixed relative to the block feature 622. A pin 628 is assembled through the holes in the forward tab 618 and the aft tab 620, and through the insert 626. The pin 628 is sized to an interference fit with the hole in the forward tab 618 and the hole in the aft tab 620, but the fit between the pin 628 and the insert 626 allows for relative rotation between the pin 628 and the insert 626, referred to as a sliding fit or a clearance fit. The block feature 622 may be of the same material as that of the liner panel 602, and, as such, may be a relatively brittle material as compared to the pin 628. The insert 626 is metallic, is softer than the pin 628 to provide a suitable interface with the pin 628 and withstands the relative motion of the pin 628, preventing undue bending or torsional stresses in the block feature 622 or the liner panel 602. The insert 626 is intended to wear, relative to the pin 628, due to the relative motion between the insert 626 and the pin 628, and may be replaced when worn beyond a determined wear threshold. A worn insert 626 is removed by pressing the worn insert 626 out, and replaced by pressing in a new insert 626.

At the forward end of the combustor 26 (FIG. 2), the fastened assemblies 614 secure the spline hoop 616. The spline hoop 616, in turn, locates the plurality of liner panels 602 radially, with respect to the combustor longitudinal centerline axis 134. Each fastened assembly 614 includes a threaded fastener 630, with a threaded end 632 and a head 634, assembled through the shell 604 and fastened with the nut 636. The plurality of fastened assemblies 614 is arranged in a circular array about the combustor longitudinal centerline axis 134. The head 634 has a transverse hole 638, arranged generally in the circumferential direction, when assembled into the fastened assembly 614. The spline hoop 616 is assembled through the transverse hole 638 in each of the heads 634 of each of the threaded fasteners 630 of each of the plurality of fastened assemblies 614, such that the spline hoop 616 is supported at regular intervals about the circumference of the plurality of liner panels 602.

To assemble the spline hoop 616 and the threaded fasteners 630, the spline hoop 616 may be split, allowing for one end of the spline hoop 616 to be fed through the transverse hole 638 in each of the threaded fasteners 630.

Figure 6E:
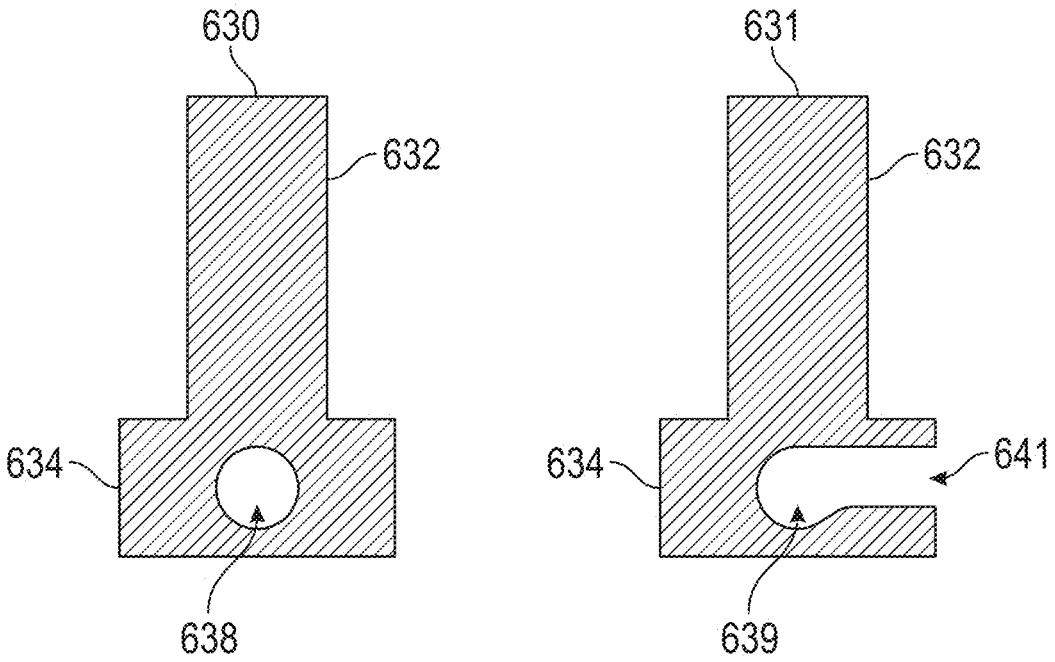
FIG. 6E is a schematic cross-sectional view of threaded fasteners, according to the present disclosure.

As shown in FIG. 6E, a threaded fastener 631 may be configured to have a hole 639 and a slot 641. The threaded fastener 631, specifically, the slot 641, allows for the spline hoop 616 to be continuous. The spline hoop 616 may be assembled to the threaded fasteners 631 by passing the spline hoop 616 laterally through the slot 641 of each threaded fastener 631.

The liner panels 602 define the combustion chamber 102, at least in part, and are exposed to the heat from combustion. The shell 604 is cooled by the flow of the portion of air 65 (*b*) (FIG. 2). This arrangement causes a significant temperature difference between the liner panels 602, and the shell 604. This temperature difference, and the variability of this temperature difference, may cause significant internal stresses to the various components if the liner mounting assembly 600 does not allow for thermal expansion. Additionally, the liner panel 602 and the shell 604 may be constructed of materials with disparate thermal expansion properties that may contribute to relative deformation or relative motion to one another, additionally contributing to stresses, if fully constrained relative to one another. Such stresses, over time and cycling, may cause degradation, wear, or failure. The spline hoop 616 includes alternating peak sections 642 and valley sections 644. In a free state, the peak sections 642 define a free state major diameter of the spline hoop 616, and, in the free state, the valley sections 644 define a free state minor diameter of the spline hoop 616.

The spline hoop 616 makes substantially point contact with the liner panels 602 at the valley sections 644 and is assembled through the transverse holes 638 at the peak sections 642. The point contact between the liner panels 602 and the spline hoop 616 permits relative sliding contact between the liner panels 602 and the spline hoop 616. This relative sliding contact, in turn, permits axial and rotational freedom of movement between the liner panels 602 and the shell 604. The flexibility of the spline hoop 616 permits diametric freedom of the liner panels 602 and the shell 604 to expand and contract, relative to one another. These freedoms of movement, as provided by the spline hoop 616, allow for relative motion, deformation, displacement, and thermal growth of the liner panel 602 and the shell 604, relative to one another.

The major diameter of the spline hoop 616 as defined by the peak sections 642 and the minor diameter of the spline hoop 616 as defined by the valley sections 644 are established as necessary to define the desired radial space between the liner panels 602 and the shell 604. In the assembled state, the peak sections 642 are slightly radially compressed, defining an assembled state major diameter less than the free state major diameter, and the valley sections 644 are expanded radially outward, to define an assembled state minor diameter greater than the free state minor diameter. These deformations allow the spline hoop 616 to maintain at least a slight radially inward force on the liner panels 602 at all operational conditions. The spline hoop 616 is constructed of a flexible material, preferably, a spring steel, able to withstand motion, deformation, and thermal expansion and contraction of the liner panels 602, relative to the shell 604, while still maintaining radial force on the liner panels 602 to radially locate the liner panels 602 relative to the combustor longitudinal centerline axis 134.

At the forward end, as shown in FIGS. 6B to 6D, a surface coating 640, such as diamond-like carbon (DLC), is applied to the radially outer surface of the plurality of liner panels 602. The surface coating 640 provides a functional surface for contact with the spline hoop 616, better suited for resisting wear under relative motion and vibration of the spline hoop 616 relative to the liner panels 602, than an otherwise bare surface of the liner panels 602. The surface coating 640 may be applied by vapor deposition, more specifically, chemical vapor deposition (CVD), and, more specifically, plasma enhanced chemical vapor deposition (PE-CVD).

Additionally, the surface coating 640 serves as a thermal insulator, providing resistance to conductive heat transfer between the liner panel 602 and the shell 604, via the spline hoop 616.

The surface coating 640 is applied circumferentially at least proximate each contact point between the plurality of liner panels 602 and the spline hoop 616. The surface coating 640 may be circumferentially discontinuous, or the surface coating 640 may be circumferentially continuous. If the surface coating 640 is circumferentially discontinuous, segments of the surface coating span at least a circumferential span large enough to remain within the interface between the liner panel 602 and the spline hoop 616 during relative rotation between the liner panel 602 and the shell 604, resulting from disparate thermal expansion or other operational events, of the various components, including at least the liner panels 602, the shell 604, and the spline hoop 616. Alternatively, the surface coating 640 may be applied along the entire circumferential span of the corresponding liner panel 602, for the purposes of simplifying or reducing the cost of manufacturing or assembly.

The surface coating 640 is applied axially at the position of the spline hoop 616. The position and the axial span of the surface coating 640 is at least long enough to remain within the interface between the spline hoop 616 and the liner panel 602, taking into consideration any motion of the liner panel 602 relative to the shell 604, and, by association, relative to the spline hoop 616, caused by disparate thermal expansion or other operational events, of the various components, including at least the liner panels 602, the shell 604, and the spline hoop 616.

Figure 7A:
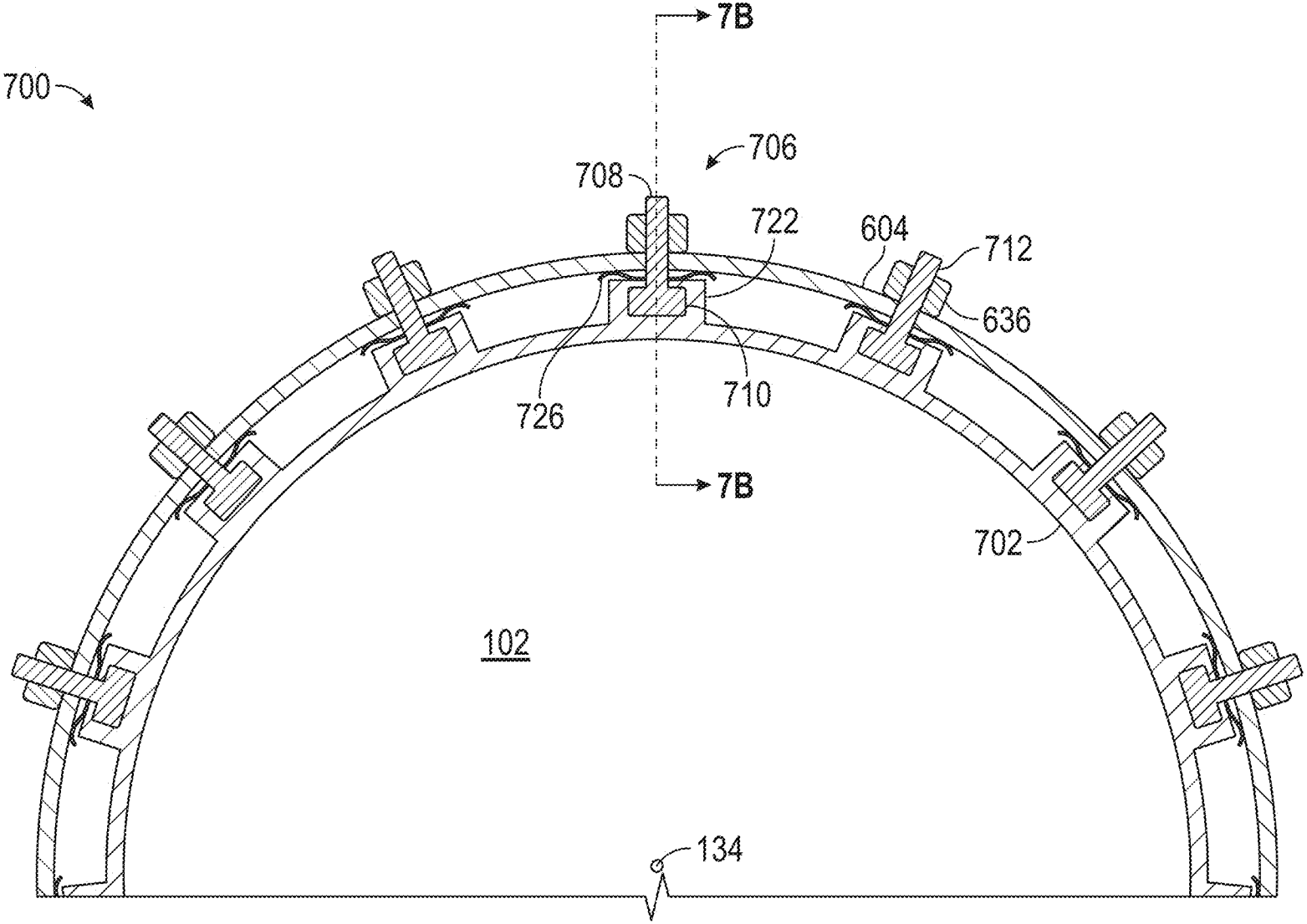
FIG. 7A is a partial cross-sectional view of a liner mounting assembly, taken orthogonally to a combustor longitudinal centerline axis, according to the present disclosure.
Figure 7B:
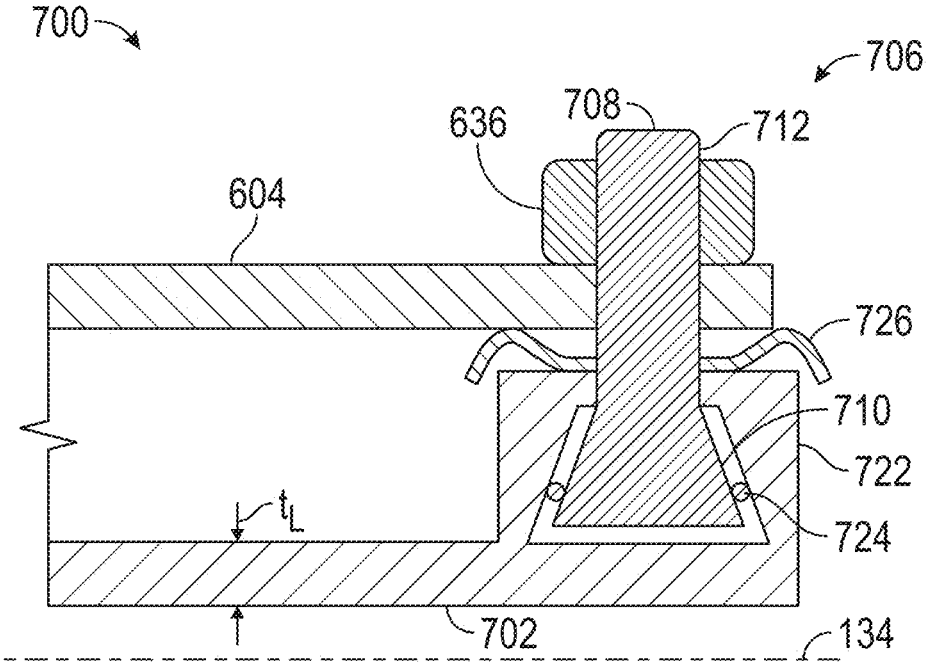
FIG. 7B is a partial cross-sectional view of a liner mounting assembly, taken at section 7B-7B as shown in FIG. 7A, according to the present disclosure.

FIG. 7A illustrates a partial schematic cross-sectional view of the liner mounting assembly 700, taken orthogonally to the combustor longitudinal centerline axis 134, and viewed longitudinally. FIG. 7B illustrates a partial schematic cross-sectional view of the liner mounting assembly 700, viewed circumferentially, taken at section 7B-7B, as shown in FIG. 7A. The liner mounting assembly 700 is substantially similar to the liner mounting assembly 600 described with respect to FIGS. 6A to 6D, except for a fastened assembly 706, as described below. Accordingly, the same reference numerals will be used for the components of the liner mounting assembly 700 that are the same as or similar to the component of the liner mounting assembly 600 as discussed above. The description of these components above also applies to this embodiment, and a detailed description of these components is omitted here.

Referring now to FIG. 7A, the liner mounting assembly 700 includes one or more liner panels 702 (one shown), arranged circumferentially, assembled to the shell 604, as viewed in the longitudinal direction, at an aft end of a combustor. The plurality of liner panels 702 is assembled to the shell 604 at a first attachment configuration, also referred to as the fastened assembly 706.

Referring again collectively to FIGS. 7A and 7B, the fastened assembly 706 is shown for attaching the liner panel 702 to the shell 604. The fastened assembly 706 constrains the liner panel 702 from relative axial displacement, radial displacement, or rotation, relative to the shell 604. The fastened assembly 706 includes a threaded fastener 708 with a head 710 and a threaded end 712. At the threaded end 712, the threaded fastener 708 attaches the shell 604 by attaching the nut 636 to the threaded end 712 of the threaded fastener 708. At the end opposite the threaded end 712, the head 710 is assembled to the liner panel 702 at a slotted receiver 722. The head 710 and the slotted receiver 722 have generally corresponding tapered shapes, as shown in FIG. 7B. Such tapered geometry aids in accurately axially positioning the liner panel 702, relative to the shell 604.

Additionally, one or more seals 724 may be installed in the fastened assembly 706, between the head 710 and the slotted receiver 722. The seal 724, similar in function to the seal 314 (FIG. 3A) and the seal 414 (FIG. 4A), is slightly compressible such that the seal 724 consumes any lash or play between the head 710 and the slotted receiver 722, and allows for a degree of radial movement, axial movement, rotation, or thermal growth of the liner panel 702, relative to the shell 604. Additionally, the seal 724 may aid in thermally insulating the shell 604 from the heat of the liner panel 702. First, the seal 724 may provide a gap for the flow of the portion of air 65 (*a*) (FIG. 2) to flow between the head 710 and the slotted receiver 722, and convectively transfer heat from the liner panel 702 to the combustion chamber 102. Second, the seal 724 may be constructed of a thermally insulating material, thus providing an insulator in the conductive flowpath of the fastened assembly 706, from the liner panel 702, through the threaded fastener 708, to the shell 604.

Finally, a Belleville washer 726 is installed in the fastened assembly 706, on the threaded fastener 708, radially between the shell 604 and the slotted receiver 722. The Belleville washer 726 acts as a spring in the radial direction, further permitting a small amount of radial deflection or diametric thermal growth of the liner panel 702, relative to the shell 604. By acting on the liner panel 702 in the radial direction, the Belleville washer 726 acts in a similar manner to the seal 724. The seal 724, however, additionally acts on the liner panel 702 in the axial direction.

Figure 8A:
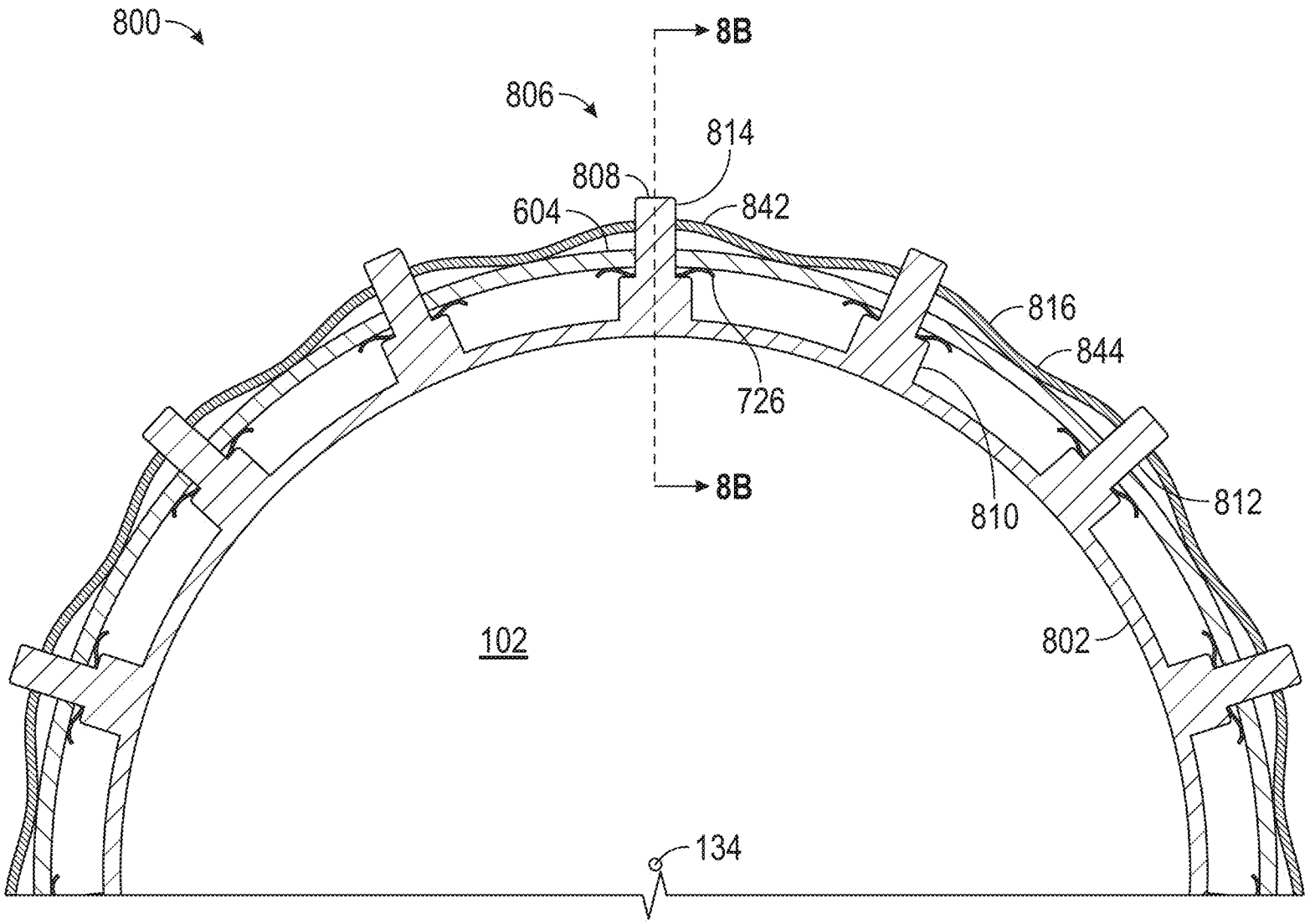
FIG. 8A is a partial cross-sectional view of a liner mounting assembly, taken orthogonally to a combustor longitudinal centerline axis, according to the present disclosure.
Figure 8B:
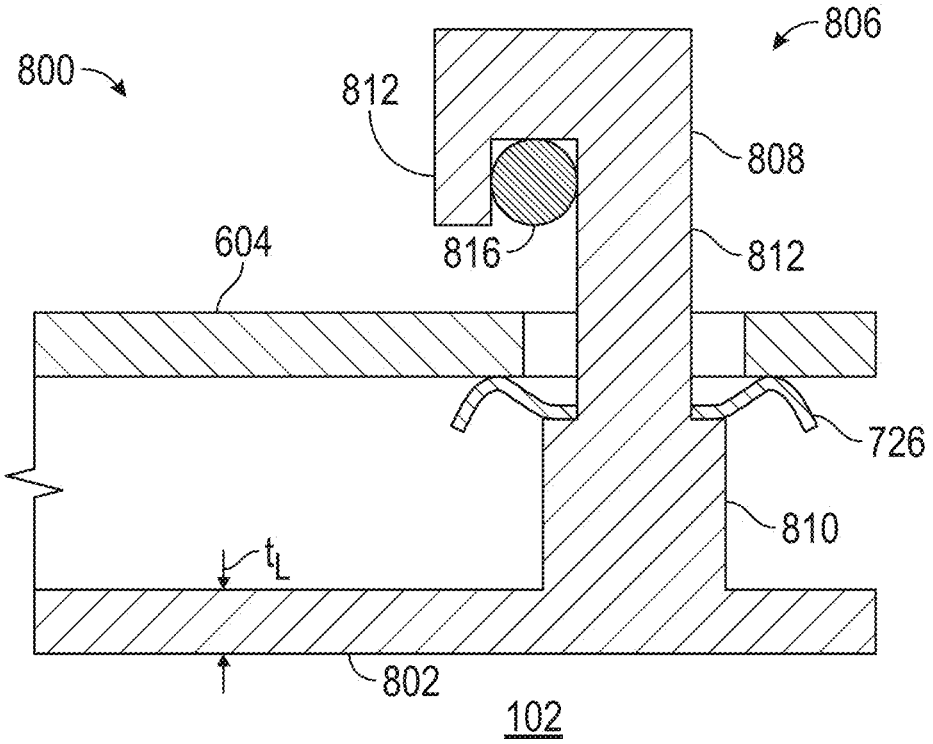
FIG. 8B is a partial cross-sectional view of a liner mounting assembly, taken at section 8B-8B as shown in FIG. 8A, according to the present disclosure.

FIG. 8A illustrates a partial schematic cross-sectional of the liner mounting assembly 800, taken at the rear of the combustor 26 as viewed longitudinally. FIG. 8B illustrates a partial schematic cross-sectional view taken at section 8B-8B, as shown in FIG. 8A. The liner mounting assembly 800 is substantially similar to the liner mounting assembly 700, described with respect to FIGS. 7A and 7B, except for a first attachment configuration in the form of a fastened assembly 806, including a spline hoop 816, as described below. Accordingly, the same reference numerals will be used for the components of the liner mounting assembly 800 that are the same as or similar to the component of the liner mounting assembly 700 as discussed above. The description of these components above also applies to this embodiment, and a detailed description of these components is omitted here.

Referring now to FIG. 8A, the liner mounting assembly 800 includes a liner, with one or more liner panels 802 (one shown), arranged circumferentially, assembled to the shell 604, as viewed in the longitudinal direction, at an aft end of a combustor. The plurality of liner panels 702 is assembled to the shell 604 at the plurality of fastened assemblies 706 (one shown), with the aid of the spline hoop 816, similar in shape and function to the spline hoop 616.

The fastened assembly 806 includes features of the liner panel 802. Specifically, the liner panel 802 includes a plurality of posts 808, each post having a base 810, a shank 812, and a hook 814. The shank 812 and the hook 814 are assembled through the holes in the shell 604. The interface of the shank 812 with the shell 604 constrains the rotation of the liner panel 802, relative to the shell 604. In the assembly of the liner mounting assembly 800, the shank 812 and the hook 814 are inserted through the shell 604 and the spline hoop 816 is inserted into the hooks 814, radially outside of the shell 604. The spline hoop 816 includes alternating peak sections 842 and valley sections 844. The peak sections 842 generally establish a free state major diameter of the spline hoop 816, whereas the valley sections 844 generally establish a free state minor diameter of the spline hoop 816. As assembled, the spline hoop 816 is compressed, such that the assembled major diameter, corresponding to the peak sections 842, is decreased relative to the free state major diameter. Additionally or alternatively, the assembled minor diameter, as established by the valley sections 844, is increased relative to the free state minor diameter. The flexibility of the spline hoop 616 permits this compression and allows for the peak section 842 to maintain a radial force outward on the hook 814 and for the valley sections 844 to maintain a radial force inward on the shell 604. These radial forces maintain the radial alignment of the plurality of liner panels 802, relative to the shell 604, despite any movement, deformation, or relative diametric thermal expansion or contraction of the liner panels 802 or the shell 604 relative to one another.

The fastened assembly 806 additionally includes the Belleville washer 726, assembled on the post 808, at the shank 812, between the shell 604 and the base 810 of the post 808. The Belleville washer 726 acts as a spring in the radial direction between the liner panel 802 and the shell 604, allowing for the expansion and contraction of the liner panels 802 and the shell 604 relative to one another, while maintaining the radial position of the plurality of liner panels 802 and the shell 604 to one another. In this way, the Belleville washer 726 serves a similar function to that of the spline hoop 816.

Figure 8C:
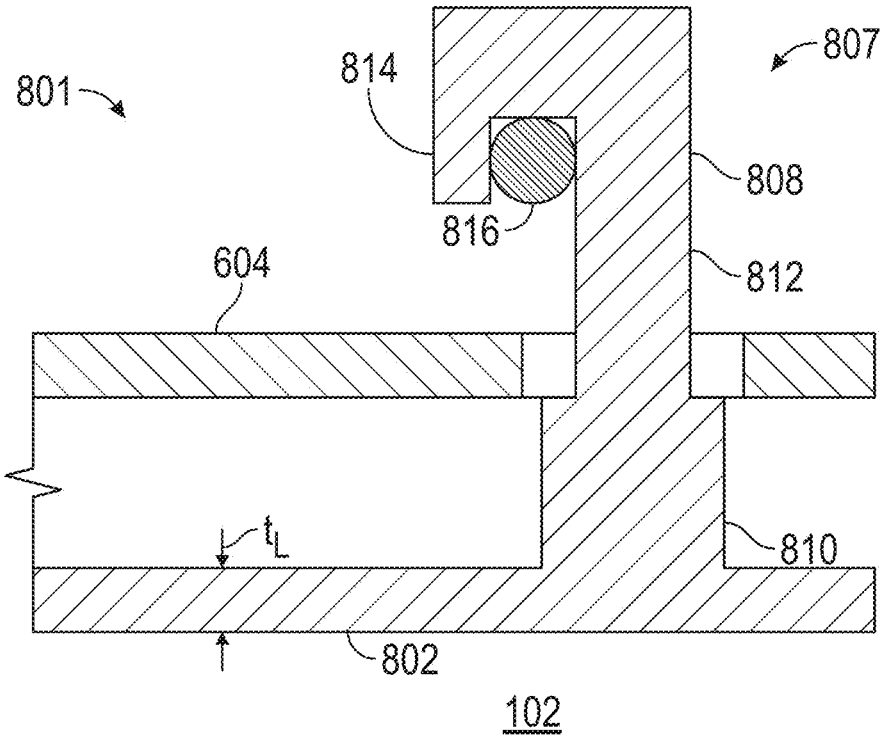
FIG. 8C is a partial cross-sectional view of a liner mounting assembly, taken along a combustor longitudinal centerline axis, according to the present disclosure.

FIG. 8C shows a partial schematic cross-sectional view of an alternative configuration of a liner mounting assembly 801 with an alternative first attachment configuration, a fastened assembly 807. The fastened assembly 807 is identical to the fastened assembly 806, except for the absence of the Belleville washer 726 in the fastened assembly 807 of the liner mounting assembly 801. As discussed above with respect to FIGS. 8A and 8B, the spline hoop 816 and the Belleville washer 726 serve similar purposes. While both are applied in the fastened assembly 806 of the liner mounting assembly 800, in order to provide a greater amount of support and centering force, radially aligning the plurality of liner panels 802 with the shell 604, the mutual application may be redundant. In the alternative embodiment of the liner mounting assembly 801, with the fastened assembly 807, the radial alignment of the plurality of liner panels 802 and the shell 604 relative to one another is provided solely by the interaction among the spline hoop 816, the hook 814 of the post 808, and the shell 604.

With reference to FIG. 2 and FIGS. 3A to 8C, the liner panels (e.g., liner panels 88, 100, 302, 402, 502, 602, 702, 802) and the liner shells (e.g., liner shells 82, 84, 304, 404, 504, 604) are extend circumferentially about the combustor longitudinal centerline axis 134. Therefore, mounting assemblies extend in the radial direction and the foregoing description refers to radial forces, inward forces, outward forces, and radial dimensions. As noted above, the mounting assemblies described with respect to FIGS. 3A to 8C may also be applied to mounting assemblies between a heat shield, such as the heat shield 114 (FIG. 2), and a dome, such as the dome 112 (FIG. 2). In such examples, the arrangement of the mounting assembly extends in an axial direction. Therefore, the prior description of forces and dimensions, as applied to a heat shield and dome mounting assembly, are directed as axial forces, aft forces, forward forces, and axial dimensions.

In the foregoing discussion of the various liner mounting assemblies, the various fastened assemblies are referenced with relative positions in the combustor, such as "aft" and "forward." Alternative embodiments are considered with the fastener assemblies located at or near the opposite end of the combustor, or at intermediate locations within the combustor.

Insulating members, such as a heat shield or a liner panel, are attached to structural members, such as a dome or a shell, in a combustor. Attachment configurations that preserve the thickness of the insulating member provide the best insulating properties. Further, a first attachment configuration that constrains the insulating member to the structural member in three dimensions, when coupled with a second attachment configuration that allows for degrees of freedom for movement, deformation, and thermal growth, provide for durability of the insulating members by reducing internal stresses in the insulating member.

Further aspects are provided by the subject matter of the following clauses.

A combustor of a turbine engine, the combustor comprising a combustion chamber for combustion of fuel and air, the combustion of the fuel and air generating heat, a mixer assembly disposed at a forward end of the combustor for receiving and mixing the fuel and the air, and injecting the fuel and the air into the combustion chamber for the combustion, at least one structural member, and an insulating member, at least in part defining the combustion chamber, having a functional thickness, and fastened to the at least one structural member without reduction in the functional thickness.

The combustor of the preceding clause, wherein the insulating member is attached to at least one structural member by a first attachment configuration that constrains the insulating member in a radial dimension, in an axial dimension and in a rotational dimension, and a second attachment configuration that constrains the insulating member in only one of the radial dimension, the axial dimension, and the rotational dimension.

The combustor of the preceding clause, wherein the first attachment configuration comprises a dovetail joint comprising a tail and a pin, wherein the tail or the pin is integral with the insulating member extending from the insulating member.

The combustor of the preceding clause, wherein the tail or the pin is integral with the at least one structural member and extends from the at least one structural member.

The combustor of any preceding clause, the first attachment configuration comprising a fastened assembly comprising a threaded fastener and the threaded fastener comprising the tail or the pin.

The combustor of any preceding clause, the dovetail joint further comprising a seal disposed between the tail and the pin.

The combustor of the preceding clause, wherein the seal is mechanically compliant and provides a clearance between the tail and the pin.

The combustor of any preceding clause, the second attachment configuration comprising a ball plate assembly, the ball plate assembly comprising a plate member comprising a first portion, contacting insulating member, the first portion comprising a plurality of spherical cavities, and a plurality of spherical ceramic balls, each of the plurality of spherical ceramic balls disposed in each of the plurality of spherical cavities, each of the spherical ceramic balls making substantially point contact with the insulating member, and a second portion, fastened to the at least one structural member, the second portion not contacting the insulating member.

The combustor of the preceding clause, wherein the ball plate assembly is flexible, having a free state thickness and an installed thickness in an installed state in the combustor, and the installed thickness is less than the free state thickness such the ball plate assembly applies a force on the insulating member in the installed state in the combustor.

The combustor of the preceding clause, further comprising an arcuate portion contacting the at least one structural member, applying a force on the at least one structural member in the installed state, and not contacting the insulating member.

The combustor of any preceding clause, the first attachment configuration comprising a threaded fastener fastened to the at least one structural member, the threaded fastener comprising a threaded end, and a saddle end comprising a forward tab with a hole in the forward tab, and an aft tab with a hole in the aft tab, a block feature integral with the insulating member and extending from the insulating member, with a hole in the block feature, and a pin assembled through the hole in the forward tab, the hole in the aft tab and the hole in the block feature.

The combustor of any preceding clause, the second attachment configuration comprising a splined hoop with alternating peak sections and valley sections, the valley sections of the splined hoop contacting the insulating member in order to constrain the insulating member in the one of the radial dimension, the axial dimension, or the rotational dimension.

The combustor of the preceding clause, wherein, in a free state the peak sections define a free state major diameter, in the free state the valley sections define a free state minor diameter, in an installed state, the peak sections define an installed state major diameter less than the free state major diameter, and in an installed state the valley sections define an installed state minor diameter greater than the free state minor diameter.

The combustor of any preceding clause, the second attachment configuration further comprising a threaded fastener fastened to the at least one structural member, the threaded fastener having a threaded end and head, the heads having holes, one of the peak sections of the splined hoop being assembled in the hole in the head.

The combustor of any preceding clause, the second attachment configuration further comprising a surface coating on the insulating member, disposed between the splined hoop and the insulating member, providing wear resistance, providing thermal insulation, or providing both wear resistance and thermal insulation.

The combustor of any preceding clause, the first attachment configuration comprising a threaded fastener fastened to the at least one structural member with a threaded end and a head, and a slotted receiver that is integral with the insulating member and extends from the insulating member, for receiving and retaining the head.

The combustor of any preceding clause, the first attachment configuration comprising a post, integral with the insulating member, the post comprising a base extending from the insulating member, a shank assembled through the at least one structural member, and a hook, and a splined hoop with alternating peak sections and valley sections, the valley sections of the splined hoop contacting the at least one structural member and one of the peak sections contacting the hook.

The combustor of the preceding clause, wherein, in a free state the peak sections define a free state major diameter, in the free state the valley sections define a free state minor diameter, in an installed state, the peak sections define an installed state major diameter less than the free state major diameter, and in an installed state the valley sections define an installed state minor diameter greater than the free state minor diameter.

The combustor of any preceding clause, wherein the insulating member is a heat shield or a liner panel.

The combustor of any preceding clause, wherein the at least one structural member is a dome or a shell.

A turbine engine comprising a compressor section that provides a compressed air flow, a fuel system that provides a fuel supply, a combustor located downstream of the compressor section, the combustor receiving the compressed air flow and the fuel supply, for combusting the compressed air flow and the fuel supply to generate combustion gases, and a turbine section located downstream of the combustor, the turbine section comprising a turbine that is caused to rotate by the combustion gases, wherein the combustor further comprises a combustion chamber for combustion of fuel and air, the combustion of the fuel and air generating heat, a mixer assembly disposed at a forward end of the combustor for receiving and mixing the fuel and the air, and injecting the fuel and the air into the combustion chamber for the combustion, at least one structural member, and an insulating member, at least in part defining the combustion chamber, having a functional thickness, and fastened to the at least one structural member without reduction in the functional thickness.

The turbine engine of the preceding clause, wherein the insulating member is attached to at least one structural member by a first attachment configuration that constrains the insulating member in a radial dimension, in an axial dimension and in a rotational dimension, and a second attachment configuration that constrains the insulating member in only one of the radial dimension, the axial dimension, and the rotational dimension.

The combustor of any preceding clause, wherein the head is a tapered head, the slotted receiver is a tapered slotted receiver, and the first attachment configuration further comprises a seal disposed between the tapered head and the tapered slotted receiver.

The combustor of any preceding clause, the first attachment configuration further comprising a Belleville washer assembled between the insulating member and the at least one structural member.

The turbine engine of any preceding clause, wherein the first attachment configuration comprises a dovetail joint comprising a tail and a pin, wherein the tail or the pin is integral with the insulating member extending from the insulating member.

The turbine engine of the preceding clause, wherein the tail or the pin is integral with the at least one structural member and extends from the at least one structural member.

The turbine engine of any preceding clause, the first attachment configuration comprising a fastened assembly comprising a threaded fastener and the threaded fastener comprising the tail or the pin.

The turbine engine of any preceding clause, the dovetail joint further comprising a seal disposed between the tail and the pin.

The turbine engine of the preceding clause, wherein the seal is mechanically compliant and provides a clearance between the tail and the pin.

The turbine engine of any preceding clause, the second attachment configuration comprising a ball plate assembly, the ball plate assembly comprising a plate member comprising a first portion, contacting the insulating member, the first portion comprising a plurality of spherical cavities, and a plurality of spherical ceramic balls, each of the plurality of spherical ceramic balls disposed in each of the plurality of spherical cavities, each of the spherical ceramic balls making substantially point contact with the insulating member, and a second portion, fastened to the at least one structural member, the second portion not contacting the insulating member.

The turbine engine of the preceding clause, wherein the ball plate assembly is flexible, having a free state thickness and an installed thickness in an installed state in the combustor, and the installed thickness is less than the free state thickness such the ball plate assembly applies a force on the insulating member in the installed state in the combustor.

The turbine engine of the preceding clause, further comprising an arcuate portion contacting the at least one structural member, applying a force on the at least one structural member in the installed state, and not contacting the insulating member.

The turbine engine of any preceding clause, the first attachment configuration comprising a threaded fastener fastened to the at least one structural member, the threaded fastener comprising a threaded end, and a saddle end comprising a forward tab with a hole in the forward tab, and an aft tab with a hole in the aft tab, a block feature integral with the insulating member and extending from the insulating member, with a hole in the block feature, and a pin assembled through the hole in the forward tab, the hole in the aft tab and the hole in the block feature.

The turbine engine of any preceding clause, the second attachment configuration comprising a splined hoop with alternating peak sections and valley sections, the valley sections of the splined hoop contacting the insulating member in order to constrain the insulating member in the one of the radial dimension, the axial dimension, or the rotational dimension.

The turbine engine of the preceding clause, wherein, in a free state the peak sections define a free state major diameter, in the free state the valley sections define a free state minor diameter, in an installed state, the peak sections define an installed state major diameter less than the free state major diameter, and in an installed state the valley sections define an installed state minor diameter greater than the free state minor diameter.

The turbine engine of any preceding clause, the second attachment configuration further comprising a threaded fastener fastened to the at least one structural member, the threaded fastener having a threaded end and head, the heads having holes, one of the peak sections of the splined hoop being assembled in the hole in the head.

The turbine engine of any preceding clause, the second attachment configuration further comprising a surface coating on the insulating member, disposed between the splined hoop and the insulating member, providing wear resistance, providing thermal insulation, or providing both wear resistance and thermal insulation.

The turbine engine of any preceding clause, the first attachment configuration comprising a threaded fastener fastened to the at least one structural member with a threaded end and a head, and a slotted receiver that is integral with the insulating member and extends from the insulating member, for receiving and retaining the head.

The turbine engine of the preceding clause, wherein the head is a tapered head, the slotted receiver is a tapered slotted receiver, and the first attachment configuration further comprises a seal disposed between the tapered head and the tapered slotted receiver.

The turbine engine of any preceding clause, the first attachment configuration comprising a post, integral with the insulating member, the post comprising a base extending from the insulating member, a shank assembled through the at least one structural member, and a hook, and a splined hoop with alternating peak sections and valley sections, the valley sections of the splined hoop contacting the at least one structural member and one of the peak sections contacting the hook.

The turbine engine of the preceding clause, wherein, in a free state the peak sections define a free state major diameter, in the free state the valley sections define a free state minor diameter, in an installed state, the peak sections define an installed state major diameter less than the free state major diameter, and in an installed state the valley sections define an installed state minor diameter greater than the free state minor diameter.

The turbine engine of any preceding clause, the first attachment configuration further comprising a Belleville washer assembled between the insulating member and the at least one structural member.

The turbine engine of any preceding clause, wherein the insulating member is a heat shield or a liner panel.

The turbine engine of any preceding clause, wherein the at least one structural member is a dome or a shell.

A method of operating a combustor, the method comprising fastening at least one insulating member to at least one structural member, the at least one structural member defining at least in part, a combustion chamber, receiving and mixing, by a mixer assembly, fuel and air to generate a fuel and air mixture, combusting the fuel and air mixture in the combustion chamber to generate heat, thermally insulating the at least one structural member with insulating member, the insulating member having a functional thickness without reduction in the functional thickness.

The method of the preceding clause, further comprising fastening the insulating member to the at least one structural member by a first attachment configuration, constraining the insulating member at the first attachment configuration in a radial dimension, in an axial dimension and in a rotational dimension, fastening the insulating member to the at least one structural member by a second attachment configuration, constraining the insulating member at the second attachment configuration in only one of the radial dimension, the axial dimension, and the rotational dimension, moving, deforming, thermally expanding, or thermally contracting the insulating member relative to the at least one structural member at the second attachment configuration, in one or two of the radial dimension, the axial dimension, or the rotational dimension.

The method of the preceding clause, wherein the first attachment configuration comprises a dovetail joint comprising a tail and a pin, wherein the tail or the pin is integral with the insulating member extending from the insulating member.

The method of the preceding clause, wherein the tail or the pin is integral with the at least one structural member and extends from at least one structural member.

The method of any preceding clause, the first attachment configuration comprising a fastened assembly comprising a threaded fastener and the threaded fastener comprising the tail or the pin.

The method of any preceding clause, the dovetail joint further comprising a seal disposed between the tail and the pin, and providing a clearance between the tail and the pin.

The method of the preceding clause, further comprising cooling the first attachment configuration by flowing air through the clearance between the tail and pin, flowing air around the tail and flowing air around the pin.

The method of any preceding clause, the second attachment configuration comprising a ball plate assembly, the ball plate assembly comprising a plate member comprising a first portion, contacting insulating member, the first portion comprising a plurality of spherical cavities, and a plurality of spherical ceramic balls, each of the plurality of spherical ceramic balls disposed in each of the plurality of spherical cavities, each of the spherical ceramic balls making substantially point contact with the insulating member, and a second portion, fastened to the at least one structural member, the second portion not contacting the insulating member.

The method of the preceding clause, further comprising applying a force by the ball plate assembly on the insulating member in the installed state in the combustor, the force due to the deformation of the ball plate assembly in an assembled state, relative to a free state.

The method of the preceding clause, the ball plate assembly further comprising an arcuate portion, and the method further comprising applying a force on the at least one structural member by the arcuate portion, the arcuate portion not contacting the insulating member.

The method of any preceding clause, the first attachment configuration comprising a threaded fastener fastened to the at least one structural member, the threaded fastener comprising a threaded end, and a saddle end comprising a forward tab with a hole in the forward tab, and an aft tab with a hole in the aft tab, a block feature integral with the insulating member and extending from the insulating member, with a hole in the block feature, and a pin assembled through the hole in the forward tab, the hole in the aft tab and the hole in the block feature.

The method of any preceding clause, further comprising constraining, by a splined hoop, the insulating member in one of the radial dimension, the axial dimension, or the rotational dimension.

The method of the preceding clause, the spline hoop having peak sections and valley sections, the method further comprising defining an assembled state major diameter by the peak sections, less than a free state major diameter, defining an assembled state minor diameter, greater than a free state minor diameter, applying a radially outward force by the spline hoop at the peak sections on the at least one structural member and applying a radially inward force by the spline hoop at the valley sections on the insulating member.

The method of any preceding clause, the second attachment configuration further comprising a threaded fastener fastened to the at least one structural member, the threaded fastener having a threaded end and head, the heads having holes, one of the peak sections of the splined hoop being assembled in the hole in the head.

The method of any preceding clause, the second attachment configuration further comprising a surface coating on the insulating member, disposed between the splined hoop and the insulating member, providing wear resistance, providing thermal insulation, or providing both wear resistance and thermal insulation.

The method of any preceding clause, the first attachment configuration comprising a threaded fastener fastened to the at least one structural member with a threaded end and a head, and a slotted receiver that is integral with the insulating member and extends from the insulating member, for receiving and retaining the head.

The method of the preceding clause, wherein the head is a tapered head, the slotted receiver is a tapered slotted receiver, and the first attachment configuration further comprises a seal disposed between the tapered head and the tapered slotted receiver.

The method of any preceding clause, the first attachment configuration comprising a post, integral with the insulating member, the post comprising a base extending from the insulating member, a shank assembled through the at least one structural member, and a hook, and a splined hoop with alternating peak sections and valley sections, the valley sections of the splined hoop contacting the at least one structural member and the peak sections contacting the hook.

The method of the preceding clause, wherein, in a free state the peak sections define a free state major diameter, in the free state the valley sections define a free state minor diameter, in an installed state, the peak sections define an installed state major diameter less than the free state major diameter, and in an installed state the valley sections define an installed state minor diameter greater than the free state minor diameter.

The method of any preceding clause, the first attachment configuration further comprising a Belleville washer assembled between the insulating member and the at least one structural member.

The method of any preceding clause, wherein the insulating member is a heat shield or a liner panel.

The method of any preceding clause, wherein the at least one structural member is a dome or a shell.

A method of operating a turbine engine, the method comprising providing, by a compressor section, a compressed air flow, providing, by a fuel system, a flow of fuel, fastening at least one insulating member of a combustor to a at least one structural member of the combustor, the at least one structural member defining at least in part, a combustion chamber, receiving and mixing, by a mixer assembly, fuel and air to generate a fuel and air mixture, combusting the fuel and air mixture in the combustion chamber to generate heat, thermally insulating the at least one structural member with insulating member, the insulating member having a functional thickness without reduction in the functional thickness.

The method of the preceding clause, further comprising fastening the insulating member to the at least one structural member by a first attachment configuration, constraining the insulating member at the first attachment configuration in a radial dimension, in an axial dimension and in a rotational dimension, fastening the insulating member to the at least one structural member by a second attachment configuration, constraining the insulating member at the second attachment configuration in only one of the radial dimension, the axial dimension, and the rotational dimension, moving, deforming, thermally expanding, or thermally contracting the insulating member relative to the at least one structural member at the second attachment configuration, in one or two of the radial dimension, the axial dimension, or the rotational dimension.

The method of the preceding clause, wherein the first attachment configuration comprises a dovetail joint comprising a tail and a pin, wherein the tail or the pin is integral with the insulating member extending from the insulating member.

The method of the preceding clause, wherein the tail or the pin is integral with the at least one structural member and extends from the at least one structural member.

The method of any preceding clause, the first attachment configuration comprising a fastened assembly comprising a threaded fastener and the threaded fastener comprising the tail or the pin.

The method of any preceding clause, the dovetail joint further comprising a seal disposed between the tail and the pin and providing a clearance between the tail and the pin.

The method of the preceding clause, further comprising cooling the first attachment configuration by flowing air through the clearance between the tail and pin, flowing air around the tail and flowing air around the pin.

The method of any preceding clause, the second attachment configuration comprising a ball plate assembly, the ball plate assembly comprising a plate member comprising a first portion, contacting insulating member, the first portion comprising a plurality of spherical cavities, and a plurality of spherical ceramic balls, each of the plurality of spherical ceramic balls disposed in each of the plurality of spherical cavities, each of the spherical ceramic balls making substantially point contact with the insulating member, and a second portion, fastened to the at least one structural member, the second portion not contacting the insulating member.

The method of the preceding clause, further comprising applying a force by the ball plate assembly on the insulating member in the installed state in the combustor, the force due to the deformation of the ball plate assembly in an assembled state, relative to a free state.

The method of the preceding clause, the ball plate assembly further comprising an arcuate portion, and the method further comprising applying a force on the at least one structural member by the arcuate portion, the arcuate portion not contacting the insulating member.

The method of any preceding clause, the first attachment configuration comprising a threaded fastener fastened to the at least one structural member, the threaded fastener comprising a threaded end, and a saddle end comprising a forward tab with a hole in the forward tab, and an aft tab with a hole in the aft tab, a block feature integral with the insulating member and extending from the insulating member, with a hole in the block feature, and a pin assembled through the hole in the forward tab, the hole in the aft tab and the hole in the block feature.

The method of any preceding clause, further comprising constraining, by a splined hoop, the insulating member in one of the radial dimension, the axial dimension, or the rotational dimension.

The method of the preceding clause, the spline hoop having peak sections and valley sections, the method further comprising defining an assembled state major diameter by the peak sections, less than a free state major diameter, defining an assembled state minor diameter, greater than a free state minor diameter, applying a radially outward force by the spline hoop at the peak sections on the at least one structural member and applying a radially inward force by the spline hoop at the valley sections on the insulating member.

The method of any preceding clause, the second attachment configuration further comprising a threaded fastener fastened to the at least one structural member, the threaded fastener having a threaded end and head, the heads having holes, one of the a peak sections of the splined hoop being assembled in the hole in the head.

The method of any preceding clause, the second attachment configuration further comprising a surface coating on the insulating member, disposed between the splined hoop and the insulating member, providing wear resistance, providing thermal insulation, or providing both wear resistance and thermal insulation.

The method of any preceding clause, the first attachment configuration comprising a threaded fastener fastened to the at least one structural member with a threaded end and a head, and a slotted receiver that is integral with the insulating member and extends from the insulating member, for receiving and retaining the head.

The method of the preceding clause, wherein the head is a tapered head, the slotted receiver is a tapered slotted receiver, and the first attachment configuration further comprises a seal disposed between the tapered head and the tapered slotted receiver.

The method of any preceding clause, the first attachment configuration comprising a post, integral with the insulating member, the post comprising a base extending from the insulating member, a shank assembled through the at least one structural member, and a hook, and a splined hoop with alternating peak sections and valley sections, the valley sections of the splined hoop contacting the at least one structural member and the peak sections contacting the hook.

The method of the preceding clause, wherein, in a free state the peak sections define a free state major diameter, in the free state the valley sections define a free state minor diameter, in an installed state, the peak sections define an installed state major diameter less than the free state major diameter, and in an installed state the valley sections define an installed state minor diameter greater than the free state minor diameter.

The method of any preceding clause, the first attachment configuration further comprising a Belleville washer assembled between the insulating member and the at least one structural member.

The method of any preceding clause, wherein the insulating member is a heat shield or a liner panel.

The method of any preceding clause, wherein the at least one structural member is a dome or a shell.

Although the foregoing description is directed to the preferred embodiments of the present disclosure, other variations and modifications will be apparent to those skilled in the art and may be made without departing from the disclosure. Moreover, features described in connection with one embodiment of the present disclosure may be used in conjunction with other embodiments, even if not explicitly stated above.

The invention claimed is:

1. A combustor for a turbine engine, the combustor comprising:

a combustion chamber for combustion of fuel and air, the combustion of the fuel and air generating heat;

a mixer assembly disposed at a forward end of the combustor for receiving and mixing the fuel and the air, and injecting the fuel and the air into the combustion chamber for the combustion;

at least one structural member; and an insulating member, at least in part defining the combustion chamber, having a functional thickness, and fastened to the at least one structural member without reduction in the functional thickness, the insulating member being attached to the at least one structural member by a first attachment configuration and a second attachment configuration, the first attachment configuration being configured to constrain the insulating member in a radial dimension, in an axial dimension, and in a rotational dimension, and the second attachment configuration being secured to the at least one structural member and contacting the insulating member, and wherein the first attachment configuration is configured to allow a portion of air from the mixer assembly to flow between the at least one structural member and the insulation member, and the second attachment configuration is configured to allow the portion of air to flow through the second attachment configuration.

2. The combustor of claim 1, wherein the second attachment configuration is configured to constrain the insulating member in only one of the radial dimension, the axial dimension, or the rotational dimension.

3. The combustor of claim 2, the second attachment configuration comprising a splined hoop with alternating peak sections and valley sections, the valley sections of the splined hoop contacting the insulating member in order to constrain the insulating member in the one of the radial dimension, the axial dimension, or the rotational dimension.

4. The combustor of claim 3, wherein, in a free state the peak sections define a free state major diameter, in the free state the valley sections define a free state minor diameter, in an installed state, the peak sections define an installed state major diameter less than the free state major diameter, and in the installed state the valley sections define an installed state minor diameter greater than the free state minor diameter.

5. The combustor of claim 3, the second attachment configuration further comprising a threaded fastener fastened to the at least one structural member, the threaded fastener having a threaded end and head, the heads having holes, one of the peak sections of the splined hoop being assembled in the hole in the head.

6. The combustor of claim 3, the second attachment configuration further comprising a surface coating on the insulating member, disposed between the splined hoop and the insulating member, providing wear resistance, providing thermal insulation, or providing both wear resistance and thermal insulation.

7. The combustor of claim 1, the first attachment configuration comprising:

a threaded fastener fastened to the at least one structural member, the threaded fastener comprising:
- a threaded end; and
- a saddle end comprising:
  - a forward tab with a hole in the forward tab; and
  - an aft tab with a hole in the aft tab;

a block feature integral with the insulating member and extending from the insulating member, with a hole in the block feature; and a pin assembled through the hole in the forward tab, the hole in the aft tab and the hole in the block feature.

8. The combustor of claim 1, the first attachment configuration comprising:

a threaded fastener fastened to the at least one structural member with a threaded end and a head; and a slotted receiver that is integral with the insulating member and extends from the insulating member, for receiving and retaining the head.

9. The combustor of claim 1, the first attachment configuration comprising:

a post, integral with the insulating member, the post comprising:
- a base extending from the insulating member;
- a shank assembled through the at least one structural member; and
- a hook; and a splined hoop with alternating peak sections and valley sections, the valley sections of the splined hoop contacting the at least one structural member and one of the peak sections contacting the hook.

10. The combustor of claim 9, wherein, in a free state the peak sections define a free state major diameter, in the free state the valley sections define a free state minor diameter, in an installed state, the peak sections define an installed state major diameter less than the free state major diameter, and in the installed state the valley sections define an installed state minor diameter greater than the free state minor diameter.

11. The combustor of claim 1, wherein the first attachment configuration comprises a dovetail joint comprising a tail and a pin, wherein the tail or the pin is integral with the insulating member extending from the insulating member.

12. The combustor of claim 11, wherein the tail or the pin is integral with the at least one structural member and extends from the at least one structural member.

13. The combustor of claim 11, the first attachment configuration comprising a fastened assembly comprising a threaded fastener and the threaded fastener comprising the tail or the pin.

14. The combustor of claim 11, the dovetail joint further comprising a seal disposed between the tail and the pin.

15. The combustor of claim 14, wherein the seal is mechanically compliant and provides a clearance between the tail and the pin.

16. The combustor of claim 1, the second attachment configuration comprising a ball plate assembly, the ball plate assembly comprising a plate member comprising:

a first portion, contacting the insulating member, the first portion comprising:
- a plurality of spherical cavities; and
- a plurality of spherical ceramic balls, each of the plurality of spherical ceramic balls disposed in each of the plurality of spherical cavities, each of the plurality of spherical ceramic balls making substantially point contact with the insulating member; and a second portion, fastened to the at least one structural member, the second portion not contacting the insulating member.

17. The combustor of claim 16, wherein the ball plate assembly is flexible, having a free state thickness and an installed thickness in an installed state in the combustor, and the installed thickness is less than the free state thickness such the ball plate assembly applies a force on the insulating member in the installed state in the combustor.

18. The combustor of claim 17, further comprising an arcuate portion contacting the at least one structural member, applying a force on the at least one structural member in the installed state, and not contacting the insulating member.

19. A turbine engine comprising:

a compressor section that provides a compressed air flow;

a fuel system that provides a fuel supply;

a combustor located downstream of the compressor section, the combustor receiving the compressed air flow and the fuel supply, for combusting the compressed air flow and the fuel supply to generate combustion gases; and a turbine section located downstream of the combustor, the turbine section comprising a turbine that is caused to rotate by the combustion gases, wherein the combustor further comprises:
- a combustion chamber for combustion of fuel and air, the combustion of the fuel and air generating heat;
- a mixer assembly disposed at a forward end of the combustor for receiving and mixing the fuel and the air, and injecting the fuel and the air into the combustion chamber for the combustion;
- at least one structural member; and
- an insulating member, at least in part defining the combustion chamber, having a functional thickness, and fastened to the at least one structural member without reduction in the functional thickness, the insulating member being attached to the at least one structural member by a first attachment configuration and a second attachment configuration, the first attachment configuration being configured to constrain the insulating member in a radial dimension, in an axial dimension, and in a rotational dimension, and the second attachment configuration being secured to the at least one structural member and contacting the insulating member, and wherein the first attachment configuration is configured to allow a portion of air from the mixer assembly to flow between the at least one structural member and the insulation member, and the second attachment configuration is configured to allow the portion of air to flow through the second attachment configuration.

20. The turbine engine of claim 19, wherein the second attachment configuration is configured to constrain the insulating member in only one of the radial dimension, the axial dimension, or the rotational dimension.

* * * * *